US010314362B2

(12) United States Patent
Bacino et al.

(10) Patent No.: US 10,314,362 B2
(45) Date of Patent: Jun. 11, 2019

(54) BOOTIES AND FOOTWEAR ASSEMBLIES COMPRISING SEAMLESS EXTENSIBLE FILM, AND METHODS THEREFOR

(71) Applicants: W. L. Gore & Associates, Inc., Newark, DE (US); W. L. Gore & Associates GmbH, Putzbrunn (DE)

(72) Inventors: John E. Bacino, Landenberg, PA (US); Norman E. Clough, Landenberg, PA (US); Orlando Collazo, Elkton, MD (US); Stane Nabernik, Kranj (SI); Franz J. Shelley, Oxford, PA (US)

(73) Assignees: W. L. Gore & Associates, Inc., Newark, DE (US); W. L. Gore & Associates GmbH, Putzbrunn (DE)

( * ) Notice: Subject to any disclaimer, the term of this patent is extended or adjusted under 35 U.S.C. 154(b) by 63 days.

(21) Appl. No.: 15/236,038

(22) Filed: Aug. 12, 2016

(65) Prior Publication Data

US 2017/0042280 A1 Feb. 16, 2017

Related U.S. Application Data

(60) Provisional application No. 62/204,758, filed on Aug. 13, 2015.

(51) Int. Cl.
*A43D 11/00* (2006.01)
*A43B 7/12* (2006.01)
(Continued)

(52) U.S. Cl.
CPC ..... *A43B 7/125* (2013.01); *A41B 11/005* (2013.01); *A43B 1/0018* (2013.01); *A43B 1/14* (2013.01);
(Continued)

(58) Field of Classification Search
CPC ..... A43D 2200/00; A43D 9/00; A43D 11/00; A43D 11/003; A43D 25/18; A43D 25/20
(Continued)

(56) References Cited

U.S. PATENT DOCUMENTS 517,210 A 3/1894 Cobb
1,785,153 A 12/1930 Swanson
(Continued)

FOREIGN PATENT DOCUMENTS

CN 2845512 12/2006
EP 0758416 2/1997
(Continued)

OTHER PUBLICATIONS

International Search Report and Written Opinion for PCT/US2016/046847 dated Feb. 21, 2017.
(Continued)

*Primary Examiner* — Marie D Bays
(74) *Attorney, Agent, or Firm* — Greenberg Traurig, LLP

(57) ABSTRACT

Waterproof, breathable socks, booties, shoe inserts, and footwear assemblies containing the shoe inserts are provided. The booties and shoe inserts may include a laminate comprising a seamless extensible film, such as a polyurethane film, and at least one textile. The bootie is suitable for a range of sizes and shoe shapes. The bootie may shrink to fit, or, alternatively, be stretched to fit, an asymmetrical last having a desired size to form a shoe insert. A bootie having a seamless extensible film eliminates the need to have multiple sizes of shoe inserts correlating to particular shoe sizes. In embodiments where the polyurethane film is seamless and continuous, the shoe insert eliminates the need for a waterproof seam tape, which is conventionally used to make shoe inserts waterproof. Methods of forming the socks, booties, and shoe inserts are also provided.

10 Claims, 13 Drawing Sheets

(51) Int. Cl.

| | |
|---|---|
| ***A43D 9/00*** | (2006.01) |
| ***A43B 1/00*** | (2006.01) |
| ***A43B 5/00*** | (2006.01) |
| ***A43B 5/04*** | (2006.01) |
| ***A43B 5/16*** | (2006.01) |
| ***A43B 19/00*** | (2006.01) |
| ***A43B 23/02*** | (2006.01) |
| ***A41B 11/00*** | (2006.01) |
| ***A43B 1/14*** | (2006.01) |
| ***A43B 17/00*** | (2006.01) |
| ***A43B 17/10*** | (2006.01) |
| ***A43D 3/02*** | (2006.01) |

(52) U.S. Cl.
CPC ..... *A43B 5/004* (2013.01); *A43B 5/0486* (2013.01); *A43B 5/1616* (2013.01); *A43B 17/006* (2013.01); *A43B 17/107* (2013.01); *A43B 19/00* (2013.01); *A43B 23/0205* (2013.01); *A43B 23/026* (2013.01); *A43B 23/0245* (2013.01); *A43D 3/02* (2013.01); *A43D 9/00* (2013.01); *A43D 11/00* (2013.01); *A41B 2400/22* (2013.01)

(58) Field of Classification Search
USPC ..... 12/146 C
See application file for complete search history.

(56) References Cited

U.S. PATENT DOCUMENTS 2,714,217 A 8/1955 Dore
2,834,987 A 5/1958 Teague
2,883,316 A 4/1959 Leahy et al.
3,130,566 A 4/1964 Chesebro
3,137,875 A 6/1964 Bingham, Jr.
3,373,512 A 3/1968 Jacobson
3,694,940 A 10/1972 Slohr
3,793,746 A 2/1974 Mitchell et al.
4,019,265 A 4/1977 Epstein
4,054,706 A 10/1977 Shapiro
4,099,342 A 7/1978 Singh
4,204,345 A 5/1980 Bradley
4,215,491 A 8/1980 Giannetti
4,433,026 A 2/1984 Molde
4,550,446 A 11/1985 Herman
4,599,810 A 7/1986 Sacre
4,809,447 A 3/1989 Pacanowsky et al.
4,845,862 A 7/1989 Phillips et al.
4,967,494 A 11/1990 Johnson
4,985,296 A 1/1991 Mortimer, Jr.
5,036,551 A 8/1991 Dailey et al.
5,044,096 A 9/1991 Polegato
5,096,473 A 3/1992 Sassa et al.
5,126,182 A 6/1992 Lumb et al.
5,191,726 A 3/1993 Vallee
5,221,572 A 6/1993 Meunier
5,222,313 A 6/1993 Dowdy et al.
5,253,434 A 10/1993 Curley, Jr. et al.
5,254,197 A * 10/1993 Klems ..... B29C 51/145 156/272.2
5,325,541 A 7/1994 Willard
5,329,807 A 7/1994 Sugar et al.
5,351,352 A * 10/1994 Chillemi ..... A43D 21/00 12/145
RE34,890 E 4/1995 Sacre
5,402,540 A 4/1995 Williams
5,409,761 A 4/1995 Langley
5,418,054 A 5/1995 Sun
5,483,703 A 1/1996 Williams
5,497,942 A 3/1996 Zingle et al.
5,499,459 A 3/1996 Tomaro
5,526,584 A 6/1996 Bleimhofer et al.
5,640,718 A 6/1997 Aldridge
5,655,226 A 8/1997 Williams
5,700,544 A 12/1997 Goodwin et al.
5,708,044 A 1/1998 Branca
5,728,169 A 3/1998 Norvell
5,802,740 A 9/1998 Merk, Sr.
5,832,539 A 11/1998 Williams
5,918,382 A 7/1999 Haderlein et al.
5,948,707 A 9/1999 Crawley et al.
5,964,047 A 10/1999 Covatch
5,981,019 A 11/1999 Goodwin et al.
6,030,428 A 2/2000 Ishino et al.
6,112,432 A 9/2000 Bray, Jr. et al.
6,151,802 A 11/2000 Reynolds
6,275,997 B1 8/2001 Richardson
6,305,101 B2 10/2001 Chemello
6,446,360 B1 9/2002 Sheets et al.
6,474,002 B2 11/2002 Chen
6,541,589 B1 4/2003 Baillie
6,665,883 B2 12/2003 Sloan
6,716,778 B1 4/2004 Hottner
6,862,820 B2 * 3/2005 Farys ..... A43B 1/0072 36/45
6,880,173 B2 4/2005 Green
6,935,053 B2 8/2005 Wiener
6,981,341 B2 1/2006 Baychar
7,055,267 B2 6/2006 Wilson et al.
7,306,729 B2 12/2007 Bacino et al.
7,314,840 B2 1/2008 Baychar
7,531,611 B2 5/2009 Sabol et al.
7,624,456 B2 12/2009 Williams et al.
7,730,555 B2 6/2010 Hexels
8,028,440 B2 10/2011 Sokolowski et al.
8,056,149 B2 11/2011 Duclos
8,176,659 B2 5/2012 von Blucher
8,435,617 B2 5/2013 Hannon
8,566,991 B2 * 10/2013 Mueller ..... A43B 7/125 12/142 T
8,569,190 B2 10/2013 Baychar
8,637,144 B2 1/2014 Ford
8,757,038 B2 * 6/2014 Siegismund ..... A43B 9/12 87/34
9,259,877 B2 * 2/2016 Fisher ..... B29C 51/46
9,351,540 B2 * 5/2016 Fisher ..... A43D 3/022
9,713,361 B2 * 7/2017 Fisher ..... A43B 23/0245
9,872,537 B2 * 1/2018 Meschter ..... A43B 23/0255
2001/0037587 A1 11/2001 Lu
2003/0029058 A1 2/2003 Lin
2003/0051375 A1 3/2003 Chun-Ming
2003/0089000 A1 * 5/2003 Tseng ..... A43B 1/00 36/45
2003/0115679 A1 * 6/2003 Morlacchi ..... A43B 7/12 8/115.51
2003/0131498 A1 7/2003 Liang
2003/0148076 A1 8/2003 Huang
2003/0167656 A1 9/2003 Tung
2004/0020077 A1 2/2004 Thomas et al.
2004/0049942 A1 3/2004 Chen
2004/0058102 A1 3/2004 Baychar
2004/0064972 A1 4/2004 Chen et al.
2004/0111787 A1 6/2004 Green
2004/0139628 A1 7/2004 Wiener
2004/0139629 A1 7/2004 Wiener
2004/0143996 A1 7/2004 Chen et al.
2004/0187352 A1 9/2004 Chen et al.
2004/0200094 A1 10/2004 Baychar
2004/0216332 A1 11/2004 Wilson et al.
2005/0034330 A1 2/2005 Baychar
2005/0076541 A1 4/2005 von Blucher
2005/0193593 A1 9/2005 Chu et al.
2005/0210708 A1 9/2005 Chen
2006/0117457 A1 6/2006 Williams et al.
2006/0137223 A1 6/2006 Ziccarelli
2006/0174517 A1 8/2006 Chang
2007/0062067 A1 3/2007 Covatch
2007/0124849 A1 6/2007 Williams et al.
2007/0227038 A1 10/2007 Edington et al.
2008/0127426 A1 * 6/2008 Morlacchi ..... A43B 7/12 8/115.51
2009/0172971 A1 7/2009 Peikert et al.

(56) References Cited

U.S. PATENT DOCUMENTS

| | | | | |
|---|---|---|---|---|
| 2009/0235433 | A1 | 9/2009 | Harris et al. | |
| 2009/0300833 | A1 | 12/2009 | Kampert et al. | |
| 2010/0011619 | A1 | 1/2010 | Bastianelli et al. | |
| 2010/0024254 | A1 | 2/2010 | Combs | |
| 2010/0248324 | A1 | 9/2010 | Xu et al. | |
| 2011/0056096 | A1 | 3/2011 | Raith et al. | |
| 2011/0061148 | A1 | 3/2011 | Egozi | |
| 2011/0167677 | A1 | 7/2011 | Peikert | |
| 2011/0179549 | A1 | 7/2011 | Zaggl et al. | |
| 2011/0265348 | A1 | 11/2011 | Schmutte | |
| 2011/0268959 | A1 | 11/2011 | Thottupurathu | |
| 2012/0073164 | A1 | 3/2012 | Linth et al. | |
| 2012/0090077 | A1 | 4/2012 | Brown | |
| 2012/0201988 | A1 | 8/2012 | Hansen et al. | |
| 2013/0086817 | A1 | 4/2013 | Myerscough | |
| 2013/0232818 | A1 | 9/2013 | Wiener | |
| 2013/0291293 | A1 | 11/2013 | Jessiman et al. | |
| 2013/0305465 | A1* | 11/2013 | Siegismund | A43B 9/12 12/146 C |
| 2014/0090273 | A1 | 4/2014 | Piontkowski | |
| 2014/0137434 | A1 | 5/2014 | Craig | |
| 2014/0237853 | A1* | 8/2014 | Fisher | A43D 3/022 36/46.5 |
| 2014/0239556 | A1* | 8/2014 | Fisher | B29C 51/46 264/511 |
| 2014/0317962 | A1* | 10/2014 | Smith | A43B 23/0205 36/102 |
| 2014/0352178 | A1 | 12/2014 | Bruce et al. | |
| 2015/0027001 | A1 | 1/2015 | VanDernoot et al. | |
| 2015/0107307 | A1 | 4/2015 | Kosui et al. | |
| 2015/0150335 | A1 | 6/2015 | Healy et al. | |
| 2015/0230541 | A1 | 8/2015 | Bacino | |
| 2015/0230542 | A1 | 8/2015 | Bacino | |
| 2015/0230543 | A1 | 8/2015 | Bacino et al. | |
| 2015/0230544 | A1 | 8/2015 | Bacino et al. | |
| 2015/0230550 | A1 | 8/2015 | Bacino et al. | |
| 2015/0230553 | A1 | 8/2015 | Bacino | |
| 2015/0230554 | A1 | 8/2015 | Bacino et al. | |
| 2015/0282564 | A1* | 10/2015 | Meschter | A43B 23/227 36/45 |
| 2016/0044985 | A1* | 2/2016 | Lien | A43B 1/04 12/142 G |
| 2016/0107404 | A1* | 4/2016 | Fisher | B29C 51/46 264/511 |
| 2016/0113356 | A1 | 4/2016 | Clough et al. | |
| 2016/0235164 | A1* | 8/2016 | Fisher | A43D 3/022 |

FOREIGN PATENT DOCUMENTS

| | | | |
|---|---|---|---|
| EP | 0850576 | A3 | 4/1999 |
| EP | 0725574 | B1 | 1/2003 |
| EP | 0927524 | B1 | 5/2003 |
| EP | 0954627 | B1 | 11/2003 |
| EP | 1522228 | A1 | 4/2005 |
| EP | 1307115 | B1 | 11/2005 |
| EP | 1621092 | A1 | 2/2006 |
| EP | 1635665 | B1 | 9/2007 |
| EP | 1860966 | B1 | 9/2009 |
| EP | 2 161 127 | A1 | 10/2010 |
| EP | 2238850 | A1 | 10/2010 |
| EP | 2353421 | A1 | 8/2011 |
| EP | 1720697 | B1 | 8/2013 |
| FR | 864911 | | 5/1941 |
| FR | 1326488 | A | 5/1963 |
| GB | 270033 | | 5/1927 |
| GB | 2408190 | | 5/2005 |
| JP | 2000-83707 | A | 3/2000 |
| JP | 2000-210104 | A | 8/2000 |
| WO | WO-01/12889 | A1 | 2/2001 |
| WO | WO-2008/015098 | A1 | 2/2008 |
| WO | WO-2013/087324 | A1 | 6/2013 |
| WO | WO-2015/123482 | A1 | 8/2015 |
| WO | WO-2015/123485 | A1 | 8/2015 |

OTHER PUBLICATIONS

International Preliminary Report on Patentability issued for Application No. PCT/US2016/046847 dated Feb. 22, 2018.

* cited by examiner

BOOTIES AND FOOTWEAR ASSEMBLIES COMPRISING SEAMLESS EXTENSIBLE FILM, AND METHODS THEREFOR

CROSS REFERENCE TO RELATED APPLICATIONS

This patent application claims priority from U.S. Provisional App. No. 62/204,758, entitled "Conformable Seamless Booties and Footwear Assemblies, and Methods Therefor," filed Aug. 13, 2015, the disclosure of which are incorporated herein by reference in its entirety.

FIELD OF THE INVENTION

The present invention relates generally to shoe inserts, and more specifically, to waterproof, breathable booties that are conformable over a range of shoe sizes. Shoe inserts incorporating the booties and methods of making the conformable booties and shoe inserts are provided. Footwear assemblies and waterproof, breathable socks are also provided.

BACKGROUND OF THE INVENTION

Waterproof, breathable footwear is typically formed of an upper material which is both air permeable and water permeable. The outer layer of the upper material may be leather and/or a textile fabric. Waterproofness is achieved through the use of a waterproof, water-vapor permeable functional material that is arranged within the shoe. In the footwear art, materials which are both waterproof and water vapor permeable are commonly referred to as "functional" materials. The functional layer may be made of an expanded polytetrafluoroethylene (ePTFE) material available from W. L. Gore and Associates, Inc., Elkton, Md., under the tradename GORE-TEX®. The expanded PTFE is characterized as having a density less than 2.0 g/cm$^3$. Other functional materials, such as polyurethanes, have also been developed and are known in the art.

It is difficult to sew the functional layer directly to the upper and/or sole material of the footwear. In addition, the functional layer becomes permeable to water when it is pierced during the sewing process. It is therefore common to provide the footwear with a shoe insert containing the functional layer. The shoe insert incorporates several pieces of a laminate that includes the functional layer and a textile material which are assembled and joined to produce an insert that includes laminate panels joined by seams in a manner to have generally the shape of a foot. A waterproof joining process may be accomplished by sewing the individual pieces together and sealing the seams with a superimposed adhesive or sealing tape that is applied to the seam by a bonding or welding process.

The shoe insert is generally attached within the footwear such that the upper end of the shoe insert is connected with the upper end of the footwear by sewing or by an adhesive. The sole portion of the shoe insert is held stationary between the outsole and the insole of the footwear, usually by adhesive bonding over the entire surface.

One problem that often results when forming such waterproof, breathable footwear is that the insertion of the shoe insert often results in a poor fitting shoe (i.e., the shoe insert has a different fit (shape or size) to that of the already sized upper) and/or poor attachment between the shoe insert and the shoe upper material, which results, among other things, in a less than desirable appearance of the inside of the footwear (i.e., the shoe insert appears wrinkled or pulls away from the upper).

An additional problem is that because of the multiple laminate pieces or panels needed for manufacturing an article of waterproof footwear, flexibility may be severely compromised. A further problem is that sealing the seamed portions of the shoe insert to make the shoe waterproof may compromise the breathability and flexibility of the shoe and contribute to the poor fit of the shoe insert.

Thus, there remains a need in the art for a shoe insert that closely conforms to the inside of the shoe, is both waterproof and breathable, and is comfortable to wear.

SUMMARY OF THE INVENTION

In one embodiment there is provided bootie or similar footwear article comprising a seamless, extensible film having a three dimensional configuration of a symmetrical or an asymmetrical last or portion thereof, wherein the film comprises a first side and a second side. In one embodiment, the film is selected from the group consisting of polyurethane (PU), polyethylene (PE), polyester (PES), polypropylene (PP), polyether (PE), polyacrylonitrile (PAN), polystyrene, polyamide, polybenzimidazole (PBI), polycarbonate, polyethylene-co-vinyl acetate (PEVA), polyvinylchloride (PVC), cellulose acetate, polyimide, and block and random copolymers thereof. In another embodiment, the film may be a porous film and is selected from the group consisting of polyurethane (PU), polyethylene (PE), polyester (PES), polypropylene (PP), polyether (PE), polyacrylonitrile (PAN), polystyrene, and copolymers thereof. The film has a minimum elongation at break of 200% or more in at least one direction. The bootie has a maximum of 25 N/cm force to stretch at 10% elongation in any direction. In addition, the bootie has an elastic recovery of at least 50% in any direction.

It is an object of the present invention to provide a footwear article, e.g., bootie, that contains a laminate including a conformed film, a first textile, and, optionally, a second textile. The first textile may form an interior portion of the bootie and the second textile may form an exterior portion of the bootie. The textile is not particularly limited as long as the textile possesses at least some elastic properties. In at least some exemplary embodiments, the extensible film is seamless. In exemplary embodiments, the first and/or second textile is a sock, which may be tubular in shape. Additionally, the sock may contain heel and/or toe reinforcements. The inclusion of heel and toe reinforcements results in the bootie having a more defined, foot-like shape, which may be self-supporting. Also, the bootie is free, or substantially free, of wrinkles. The seamless, extensible film comprises a conformed film having a three dimensional configuration of a symmetrical last or portion thereof giving the bootie a generally symmetrical shape.

It is also an object of the present invention to provide a footwear article, e.g., shoe insert, that includes a laminate that includes (1) a seamless, extensible shaped film and (2) a textile positioned on one side of the seamless, extensible shaped film. A second textile may be provided on a second side of the seamless, extensible shaped film opposing the textile. The textiles may be a knitted textile tube, a woven textile tube, a tubular sock, or a sock having reinforced heel and/or toe region(s). In addition, the textile possesses at least some elastic properties. Additionally, the seamless, extensible shaped film may have thereon a coating, such as an oleophobic coating and/or an abrasion resistant coating. The shoe insert has generally the shape of the asymmetrical last. In particular, the shoe insert may have a three dimensional configuration of an asymmetrical last or portion thereof.

It is another object of the present invention to provide a footwear article that includes a laminate that includes (1) an upper portion, (2) a shoe insert adjacent to or with the upper portion, and (3) a sole portion adjacent to or with the upper portion and the shoe insert. The shoe insert includes a seamless, extensible shaped film, a first textile affixed to one side of the shaped film, and optionally, a second textile affixed to a second side of the shaped film. The seamless, extensible shaped film may have a thickness variation from a first location in the shoe insert to a second location in the shoe insert. The shoe insert may be affixed to the upper portion and/or sole portion of the footwear article or, alternatively, the shoe insert may be removable. There are substantially no air gaps between the upper portion of the footwear article and the shoe insert. Footwear articles including the shoe insert do not demonstrate leaking when filled with water and centrifuged for 30 minutes, thus passing the Centrifuge Waterproofness Test described herein. A polymeric overlay may be positioned on the shoe insert to provide additional cushioning, stability, and/or support. The inclusion of polymeric overlays may permit the "overlayed" shoe insert to be worn in an indoor or outdoor environment without being part of a shoe.

It is yet another object of the present invention to provide a waterproof sock that includes a laminate that includes (1) a seamless, extensible conformed film and (2) a first elastic textile affixed to a first side of the conformed film. The seamless, extensible conformed film may have a thickness variation from a first location in the waterproof sock to a second location in the waterproof sock. A second elastic textile may be affixed to a second side of the conformed film. The textile(s) selection is not particularly limited so long as the textile possesses at least some elastic properties. In at least one embodiment, the textile(s) may be a textile tube, a tubular sock, or a conventional sock with reinforced heel and/or toe regions. The waterproof sock is formed on a symmetrical last, and as a result, the waterproof sock has a generally symmetrical shape. The waterproof sock does not demonstrate leaking when filled with water and centrifuged for 15 minutes, thus passing the Centrifuge Waterproofness Test described herein. In one embodiment, the extensible conformed film is densified, which renders the sock non-breathable but provides the wearer protection from an aggressive environment. In a further alternative embodiment, a shaped waterproof sock may be formed, or shaped, with the application of heat (e.g., in a conventional oven) on a conventional asymmetrical last to provide the shaped waterproof, breathable sock.

It is a further object of the present invention to provide a method of forming a shoe insert that includes (1) applying an adhesive to a first side of a textile to form a first composite, (2) positioning the first composite on a symmetrical last with the adhesive facing outwardly and away from the symmetrical last, (3) stretching an extensible film in at least one direction over the first composite to form a second composite that includes the extensible film, the adhesive, and the textile, (4) heating the second composite and the symmetrical last to an elevated temperature, generally about 130-150° C., or in another suitable range, to form a bootie, (5) placing the bootie on an asymmetrical last, and (6) heating the bootie and the asymmetrical last to an elevated temperature generally about 130-150° C., or in another suitable range, to form a shoe insert. The shoe insert may be cooled before removing it from the asymmetrical last. The stretching step may include (1) positioning the extensible film over the symmetrical last and (2) rotating the symmetrical last through the extensible film to form the second composite. In the second heating step, the bootie shrinks to fit the asymmetrical last. In an alternative embodiment, the bootie may be made to be somewhat smaller than the asymmetrical last and the bootie is stretched to fit over the asymmetrical last. In some embodiments, the extensible film may have a thickness variation from a first location in the shoe insert to a second location in the shoe insert.

It is also an object of the present invention to provide a method of forming a shoe insert that includes (1) applying a first adhesive to a first side of a first textile to form a first composite, (2) positioning the first composite on a symmetrical last with the first adhesive facing outwardly and away from the symmetrical last, (3) stretching an extensible film in at least one direction over the first composite to form a second composite comprising the extensible film, the first adhesive, and the first textile, (4) positioning a second textile having thereon a second adhesive on the second composite such that the second adhesive is located on the extensible film to form a third composite, (5) heating the third composite and the symmetrical last to an elevated temperature generally about 130-150° C., or in another suitable range, to form a bootie, (6) placing the bootie on an asymmetrical last, and (7) heating the bootie and the asymmetrical last to an elevated temperature generally about 130-150° C., or in another suitable temperature range, to form a shoe insert. The shoe insert may be cooled before removing the shoe insert from the asymmetrical last. As noted earlier herein, in some embodiments, the shoe insert may be seamless. The extensible film may have a thickness variation from a first location in the shoe insert to a second location in the shoe insert. The stretching step may include (1) positioning the extensible film over the symmetrical last and (2) rotating the symmetrical last through the extensible film to form the second composite. Alternatively, the bootie may be made to be somewhat smaller than the asymmetrical last and the bootie is stretched to fit over the asymmetrical last.

It is another object of the present invention to provide a method of forming a bootie that includes (1) applying an adhesive to a first side of a textile to form a composite, (2) positioning the composite on a symmetrical last with the adhesive facing outwardly and away from the symmetrical last, and (3) stretching an extensible film having an extensibility in at least one direction over the composite and the symmetrical last to form a bootie. The bootie is thus formed of an extensible film, an adhesive, and a textile. The stretching step may include positioning the extensible film over the symmetrical last and rotating the symmetrical last through the extensible film. In other embodiments, the bootie is stretched over the asymmetrical last.

It is yet another object of the present invention to provide a method of forming a shoe insert that includes (1) applying an adhesive on one of a first textile or a side of an extensible film having an extensibility in at least one direction, (2) positioning the textile on a symmetrical last, (3) stretching the extensible film over the textile to form a first composite, (4) positioning a second composite including a second adhesive on a second textile on the first composite such that the second adhesive is positioned on the extensible film to form a bootie, (5) placing the bootie on an asymmetrical last, and (5) heating the bootie and the asymmetrical last to an elevated temperature, generally from about 130-150° C., or another suitable range, to form the shoe insert. The stretching step may include rotating the symmetrical last through the extensible film. The placing step may include stretching the bootie over the asymmetrical last. The first and second textiles may be a knitted textile tube, a woven textile tube, a tubular sock, or a formed sock having heel and/or toe reinforcements. The shoe insert may be self-supporting, such as, for example when the textile is a formed sock having heel and toe reinforcements.

It is also an object of the invention to provide a method of forming a bootie that includes (1) applying an adhesive on a side of a first textile or a side of an extensible film having an extensibility in at least one direction, (2) positioning the textile on a symmetrical last, (3) stretching the extensible film over the textile and symmetrical last to form a first composite, (4) positioning a second composite comprising a second adhesive on a second textile on the first composite such that the second adhesive is positioned on the extensible film to form a bootie, and (5) heating the bootie to a temperature of about 130-150° C., or in another suitable range. The bootie has a generally symmetrical shape, and may be breathable over its entirety.

It is a further object of the present invention to provide a bootie that is formed of a seamless, extensible film and no textile. The seamless, extensible film may have a three dimensional configuration of a symmetrical or an asymmetrical last or portion thereof. The seamless, extensible film, such as an extensible polyurethane film, may have thereon a coating, such as an oleophobic coating and/or an abrasion resistant coating. Additionally, the seamless, extensible film may have a thickness variation from a first location in the bootie to a second location in the bootie. The bootie may be formed by stretching an extensible film over a symmetrical last in a single step. The bootie has a shape substantially similar to the symmetrical last. In addition, the bootie may be heated to a temperature of generally about 130-150° C., or in another suitable range, to reduce the ability of the extensible film to further stretch and/or to deform.

It is another object of the present invention to provide a shoe insert that is formed of a seamless, extensible shaped film and no textile. The shaped film may have at least one coating layer thereon, such as, but not limited to, an abrasion resistant coating and/or an oleophobic coating. In one embodiment, the shaped film has an abrasion resistant coating on at least one of an inner surface of the shoe insert and an outer surface of the shoe insert. The shoe insert may be formed in a one step process whereby an extensible film is stretched over an asymmetrical last. The shoe insert has a shape substantially similar to the asymmetrical last. The shoe insert may be heated to a temperature of generally about 130-150° C., or in another suitable temperature range, to reduce the ability of the extensible film to further stretch and/or to deform. In a further embodiment, the shoe insert has a polymeric overlay attached thereto to provide additional cushioning, stability, and/or support.

It is a further object of the present invention to provide a shoe insert formed of a seamless, extensible conformed film, such as a polyurethane film. The shoe insert may be formed by stretching an extensible film over a symmetrical last. The extensible film may have a thickness variation from a first location in the shoe insert to a second location in the shoe insert. The shoe insert may be breathable over its entirety. Additionally, the shoe insert may be both waterproof and breathable. In at least one embodiment, the shoe insert does not contain a textile and has a shape substantially similar to the symmetrical last.

It a further object of the present invention to provide a bootie, shoe insert, or waterproof, breathable sock that contains (1) a laminate comprising first seamless, extensible film having a three dimensional configuration of a symmetrical or an asymmetrical last or portion thereof, and at least one textile and (2) a second component attached to the laminate, such as with a seam. In exemplary embodiments, the polyurethane film is seamless. The second component may be, for instance, a textile, a laminate (e.g., a laminate including a polymer membrane), a textile laminate, a polymer membrane (e.g. polytetrafluoroethylene or expanded polytetrafluoroethylene), or a second seamless, extensible film different from the first seamless, extensible film (e.g., having a characteristic or property different from the first seamless, extensible film) in the bootie, shoe insert, or waterproof, breathable sock. The selection of the second material is not particularly limited, and may be selected depending on the desired quality or property desired. It is to be appreciated that the additional material(s) may be used, for example, to tailor the bootie, shoe insert, or waterproof, breathable sock to achieve desired properties and/or a desired appearance.

It is yet another object of the present invention to provide a hybrid bootie, shoe insert, or sock where a portion of the bootie, shoe insert, or sock is removed and the partial bootie, shoe insert, or sock is attached to a second component. The second component may be attached to the partial bootie, shoe insert, or sock by at least one seam. In one embodiment, the bootie, shoe insert, or waterproof, breathable sock may be cut or otherwise portioned and that portioned piece of the bootie, shoe insert, or waterproof, breathable sock may be attached to the second component.

It is also an object of the present invention to provide a bootie, shoe insert, or waterproof, breathable sock that includes an seamless, extensible film that contains at least one integrally joined interface, and optionally, at least one textile. In one embodiment, an opening or fold is created in the seamless, extensible film, and the seamless, extensible film together at the opening or fold by creating an integrally joined interface. In some embodiments, a second component may be attached to the bootie, shoe insert, or waterproof sock (or a portion thereof) by any conventional methods, such as by a seam.

It is another object of the present invention to provide a bootie, shoe insert, or waterproof, breathable sock that contains a laminate of a seamless, extensible film and at least one textile where a portion of the laminate is removed and the partial laminate is affixed to at least one second component. In one embodiment, there is provided bootie, shoe insert, or waterproof, breathable sock comprising a first portion comprising a laminate, the laminate comprising a seamless, extensible film having a three dimensional configuration of a symmetrical or an asymmetrical last or portion thereof, wherein the film comprises a first side and a second side, wherein the film is selected from the group consisting of polyurethane (PU), polyethylene (PE), polyester (PES), polypropylene (PP), polyether (PE), polyacrylonitrile (PAN), polystyrene, polyamide, polybenzimidazole (PBI), polycarbonate, polyethylene-co-vinyl acetate (PEVA), polyvinylchloride (PVC), cellulose acetate, polyimide, and block and random copolymers thereof; and a textile on at least one of the first and/or second side; and a second portion attached to the first portion, wherein the second portion is selected from the group consisting of a textile, a second component laminate, a textile laminate, a membrane, or a second film different from said seamless, extensible film.

It is an advantage of the present invention that the extensible film in the bootie, shoe insert, and waterproof sock may be seamless. In one embodiment, the extensible polyurethane film in the bootie, shoe insert, and waterproof sock may be seamless.

It is another advantage of the present invention that shoes made with shoe inserts having a seamless, extensible film have enhanced breathability over shoes made with conventional shoe inserts made by sewing together pieces of laminate material and sealing by a bonding or welding process.

It is yet another advantage of the present invention that the shoe inserts conform closely to the inside of the shoe, thereby reducing and even eliminating air gaps between the insert and the shoe.

It is a further advantage of the present invention that the bootie is conformable over a range of shoe sizes and shapes.

It is also an advantage of the present invention that the sole portion of the shoe may have breathability.

It is yet another advantage of the present invention that a shoe insert having a seamless, extensible film contains little or no wrinkles, which increases wear comfort for the user.

It is a feature of the present invention that the bootie conforms in a thermal heating step to shrink to fit a conventional asymmetrical last over a range of sizes.

It is yet another feature of the present invention that the bootie can be stretched to fit a conventional asymmetrical last over a range of sizes.

It is also a feature of the present invention that a polymeric overlay may be positioned on a bootie, shoe insert, or waterproof, breathable sock to provide additional cushioning, stability, and/or support.

It is another feature of the present invention that the inclusion of polymeric overlays on the shoe insert permits the "overlayed" shoe insert to be worn in an indoor or outdoor environment without being part of a shoe.

It is a further feature of the present invention that the textile used to form the shoe insert may be a conventional sock, a knitted textile tube, or a woven textile tube.

It is yet another feature of the present invention that the reduction or elimination of air gaps between the insert and the shoe reduces water pick up.

It is also a feature of the present invention that the film may be densified, which renders the bootie, shoe insert, or sock non-breathable but provides the wearer protection from an aggressive environment.

It is another feature of the present invention that the seamless booties, shoe inserts, and socks are breathable over their entireties.

It is another feature of the present invention that the seamless booties, shoe inserts, and socks are self-supporting.

It is another feature of the present invention that the lack of seam tape on the seamless, extensible film within the shoe insert reduces the weight of the insert compared to conventional inserts or booties made with seam tape.

DEFINITIONS

The term "extensibility" or "extensible" as used herein is meant to define the capability of the film to elongate or stretch. The extensible film as used herein may refer to the property of the film material prior to being made footwear articles having a three-dimensional configuration of a last or portion thereof and once made into the three-dimensional footwear articles the film may not be extensible, but the film may be referred to as an extensible film in the footwear article, such as bootie, shoe insert or sock. In certain embodiments, the extensible film has a minimum elongation at break of 200% or more in at least one direction, e.g., 300% or more, or 500% or more, according to ASTM D 638 (2003). In one embodiment, the extensible film has a minimum elongation at break of 200% to 500% in at least one direction. In one embodiment, extendable or extensible describes a film that is elongated to conform to the shape of a three dimensional object, such as a last, without fracturing, tearing, or otherwise breaking.

The term "film" as used herein refers to a layer or membrane that comprises a material that is selected from the group consisting of polyurethane (PU), polyethylene (PE), polyester (PES), polypropylene (PP), polyether (PE), polyacrylonitrile (PAN), polystyrene, polyamide, polybenzimidazole (PBI), polycarbonate, polyethylene-co-vinyl acetate (PEVA), polyvinylchloride (PVC), cellulose acetate, polyimide, and block and random copolymers thereof. In certain embodiments, the film is an extensible film. It is to be understood that the films described herein may be porous and may be selected from the group consisting of polyurethane (PU), polyethylene (PE), polyester (PES), polypropylene (PP), polyether (PE), polyacrylonitrile (PAN), polystyrene and copolymers thereof. In addition, the films may be waterproof and/or breathable. The film may be a conformable film, meaning that the conformable film adopts the shape of an article, e.g., last, when being formed.

As used herein, the terms "sock", "bootie", and "shoe insert" are meant to describe footwear articles that encase the foot of the wearer.

The term "conformed" as used herein is meant to describe footwear articles (e.g., sock, bootie, or shoe insert) comprising film, such as a polyurethane film, having substantially the shape of a symmetrical last or a portion thereof. In one embodiment, the extensible conformed film has a three dimensional configuration of a symmetrical last or a portion thereof.

The term "shaped" as used herein is meant to describe footwear articles (e.g., sock, bootie, or shoe insert) comprising a film, such as a polyurethane film, having substantially the shape of an asymmetrical last or a portion thereof. In one embodiment, the extensible shaped film has a three dimensional configuration of an asymmetrical last or a portion thereof.

As used herein, the term "textile" is meant to denote any woven, nonwoven, felt, knit, stretch spunbond nonwoven, stretch needlepunched non-woven, stretch spunlace nonwoven, or fleece and can be composed of natural and/or synthetic fiber materials and/or other fibers or flocking materials that has at least some elastic properties.

The term "elastic" as used herein is meant to denote that the material has stretch characteristics and can be tensioned; and, upon the release of tension, the material returns to its approximate original dimensions.

The term "highly elastic" or "high elasticity" as used herein is meant to describe materials that have stretch characteristics and can be tensioned at least about 50% (or greater); and, upon the release of tension, the material returns to its approximate original dimensions.

The term "seam" or "seamed" as used herein is meant to include the joining of two portions, regions, or materials. A seam may join similar or identical materials or two or more dissimilar materials (e.g. dissimilar textile pieces or a laminate to a shoe insert). The terms "seam" and "seamed" are not intended to be limited to stitching and/or sewing. "Seam" and "seamed" as used herein are meant to include any suitable means of joining two portions regions, or materials, such as by adhesives, bonding, welding, laminating, and the like.

The term "integrally joined interface" is meant to describe the joining or attachment of an extensible film to itself (i.e., the same extensible film), such as when the extensible film has been folded, cut, torn, slit, punctured, or otherwise damaged. The joining or attachment of the extensible film to itself may be accomplished by any suitable means of attachment, such as, for example, sewing, stitching, gluing, stapling, patching, etc.

The phrase "waterproof sock" is meant to describe a seamless waterproof sock made in accordance with the methods described herein.

The phrase "hybrid shoe insert" as used herein is meant to describe a shoe insert that has included therein one or more region(s) that has a different function(s) or different material(s) from the shoe insert.

The phrase "hybrid bootie" as used herein is meant to describe a bootie that has included therein one or more region(s) that has a different function(s) or different material(s) from the bootie.

The phrase "hybrid sock" as used herein is meant to describe a sock that has included therein one or more region(s) that has a different function(s) or different material(s) from the sock.

The tem "waterproof" as used herein is meant to define a bootie, shoe insert, shoe, or sock that meets the Waterproof Centrifuge Tests described herein.

The term "self-supporting shoe insert" as used herein is meant to describe a shoe insert that maintains an upright, substantially vertical orientation with respect to a horizontal surface without any external support.

The term "self-supporting bootie" as used herein is meant to describe a bootie that maintains an upright, substantially vertical orientation with respect to a horizontal surface without any external support.

The term "self-supporting sock" as used herein is meant to describe a sock that maintains an upright, substantially vertical orientation with respect to a horizontal surface without any external support.

The term "thickness variation" as used herein is meant to describe a ratio of the difference in thickness of the extensible film at a first position compared to a second position.

The term "on" as used herein is meant to denote that when an element is "on" another element, it can be directly on the other element or intervening elements may also be present.

The terms "adjacent" and "adjacent to" as used herein are meant to denote that when an element is "adjacent" to another element, the element may be directly adjacent to the other element or intervening elements may be present.

The term "over" as used herein is meant to denote that when an element is "over" another element, it can be directly over the other element or intervening elements may also be present.

The terms "additional component" or "second component" as used herein are meant to describe any material, such as a textile, a laminate (e.g. including a polymer membrane), a textile laminate, a polymer membrane (e.g., polytetrafluoroethylene or expanded polytetrafluoroethylene), a second extensible film different from the first extensible film (e.g., having a characteristic or property different from the first extensible film), that is attached by at least one seam to a bootie, shoe insert, or breathable sock described herein.

BRIEF DESCRIPTIONS OF FIGURES

The advantages of this invention will be apparent upon consideration of the following detailed disclosure of the invention, especially when taken in conjunction with the accompanying drawings wherein.

DETAILED DESCRIPTION OF THE INVENTION

Figure 1:
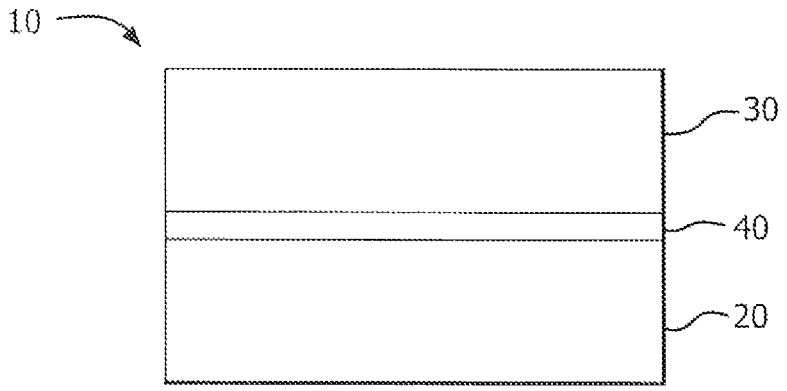
FIG. 1 is a schematic illustration depicting a cross section of a laminate forming a 2-layer shoe insert in accordance with the present invention having one textile layer.

The present invention relates to three dimensional waterproof, breathable, and conformable booties and shoe inserts formed from the conformable booties, as well as footwear articles incorporating the shoe inserts therein. The present invention also relates to three dimensional waterproof, breathable socks. In exemplary embodiments, the booties, shoe inserts, and waterproof, breathable socks include a seamless, extensible film and optionally, at least one textile. The film is selected from the group consisting of polyurethane (PU), polyethylene (PE), polyester (PES), polypropylene (PP), polyether (PE), polyacrylonitrile (PAN), polystyrene, polyamide, polybenzimidazole (PBI), polycarbonate, polyethylene-co-vinyl acetate (PEVA), polyvinylchloride (PVC), cellulose acetate, polyimide, and block and random copolymers thereof. For purposes of illustrate the extensible film may be represented as a polyurethane film, but it should be understood that any of the suitable films materials may be used.

The bootie is conformable over a range of sizes and shoe shapes (e.g., right and left). For instance, the bootie may be shaped to fit numerous sizes and shapes (e.g., right and left) of shoe lasts, thereby eliminating the need to have multiple sizes of shoe inserts correlating to particular shoe sizes. The bootie may shrink to fit, or, alternatively, be stretched to fit, a last having a desired size to form a shoe insert. The shoe insert reduces or eliminates the need for a waterproof seam tape, which is conventionally used to make shoe inserts waterproof. It is to be appreciated that the terms "shoe" and "boot" as used herein is meant to include men's, women's, and children's shoes (casual, dress, and running) and boots, respectively.

The extensible film used in forming the booties, shoe inserts, and waterproof socks described herein is capable of elongating or stretching. The extensible film may or may not be heated prior to elongation or stretching. Additionally, the extensible film may be elongated or stretched over a three dimensional object to conform to the shape of a three dimensional object without fracturing, tearing, or otherwise breaking.

One non-limiting example of a suitable polyurethane film is sheet of breathable polyurethane film such as that available with the part number HSLEU28 from Smith & Nephew Extruded Films Limited, Broad Lane, Gilberdyke, East Yorkshire, HU15 2TD, United Kingdom, with an elongation at break of 650% in both directions. The elongation at break of a material, also known as the fracture strain is a measure of the amount of elongation (or strain) that the material can experience until failure in tensile testing. The elongation at break is typically expressed as a percentage of the original material length (length at rest) e.g. if a material reaches twice the original length before failure during tensile testing, it's elongation at break is 100%. It is generally understood by those of skill in the art that soft, elastic materials have high percent elongation at break values of 100% or more whereas hard, brittle materials have significantly lower % elongation at break values of 20% or less.

To conform materials into complex seamless three dimensional articles, high percent elongation of break values of 200% or more are highly desired in one or more directions for the extensible films. In certain embodiments, the extensible film has a minimum elongation at break of 200% or more in at least one direction, e.g., 300% or more, or 500% or more.

In addition, the incorporation of filler materials in various forms within the extensible films is also considered to be within the purview of the invention. Non-limiting examples of suitable filler materials include carbon black, aerogels, metals, semi-metals, ceramics, carbon/metal particulate blends, activated carbon, and the like.

Figure 3A:
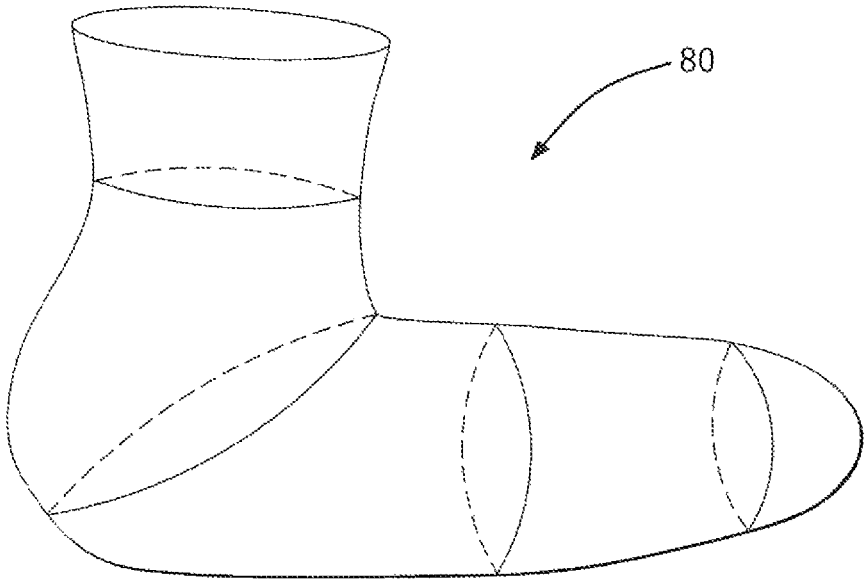
FIG. 3A is a schematic illustration of a symmetrical last according to at least one embodiment of the invention.
Figure 3B:
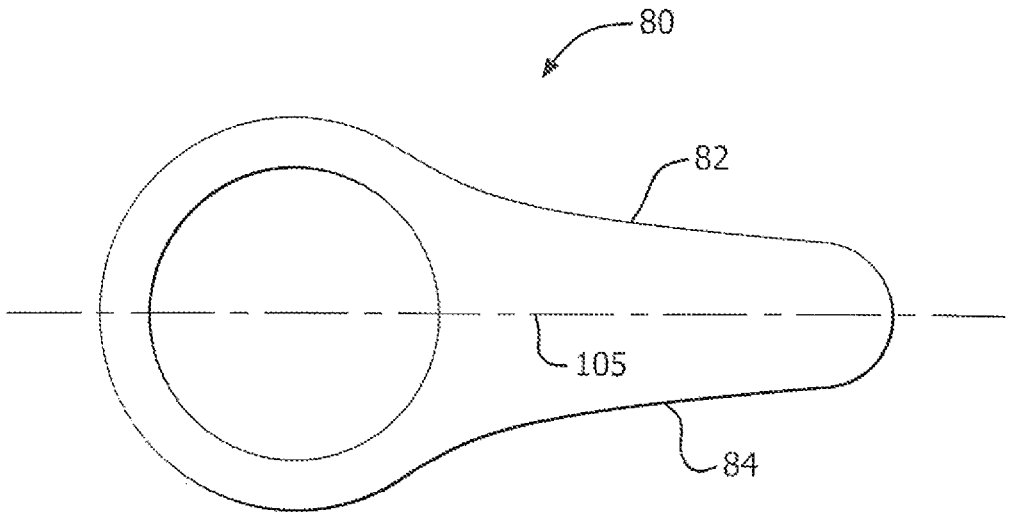
FIG. 3B is a schematic illustration of the top view of the symmetrical last of FIG. 3A showing an axis of symmetry.

To minimize film variability during the formation of the shoe insert, a symmetrical foot last may be utilized. A schematic illustration of a symmetrical last 80 is depicted in FIGS. 3A and 3B. The last 80 may be formed of virtually any material, such as, for example, a polymer (e.g., nylon) or a metal (e.g., aluminum materials). A silicon coating, or other suitable coating, may be applied to act as a release liner. Unlike conventional lasts, the symmetrical last 80 has no left or right features or designations. As shown in FIG. 3B, the symmetrical last 80 is symmetrical along a centrally located axis represented by reference numeral 105. Thus, the portions 82 and 84 on either side of the centrally located axis 105 are mirror images, or substantially mirror images of each other. It is to be appreciated that the symmetrical last 80 may be formed to have different shapes and/or sizes depending on the end use of the article. For example, a shoe insert for a running shoe and a shoe insert for a casual shoe may be made using different symmetrical lasts due to the different and specific needs of the two shoe types. Additionally, the symmetrical design of the last can be changed to allow for additional shoe construction features, such as, for example, additional tongue gusset materials, size, width, shoe types, etc, so long as the symmetry along a centrally located axis remains intact. The symmetrical last 80 can therefore be customized to meet a variety of shapes and sizes to meet desired end uses.

Figure 4A:
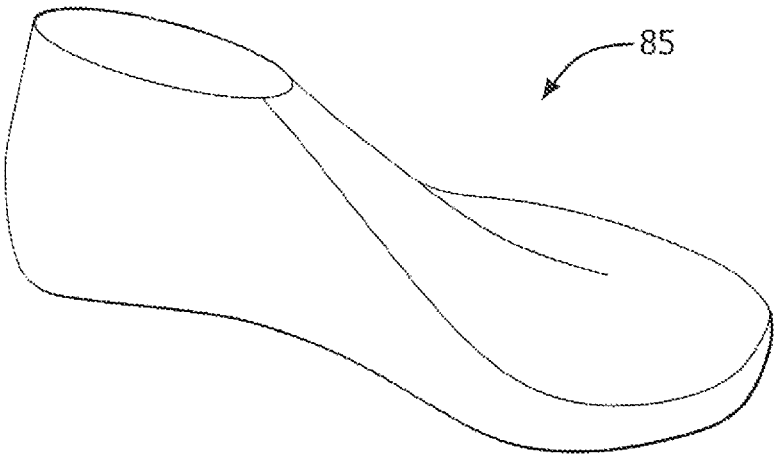
FIG. 4A Prior Art
FIG. 4A is a schematic illustration of a conventional asymmetrical last.
Figure 4B:
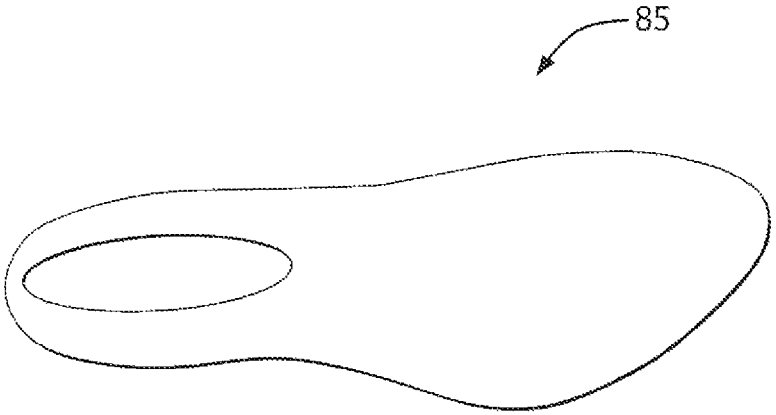
FIG. 4B Prior Art
FIG. 4B is a schematic illustration of the top view of the asymmetrical last of FIG. 4A showing no axis of symmetry.
Figure 5:
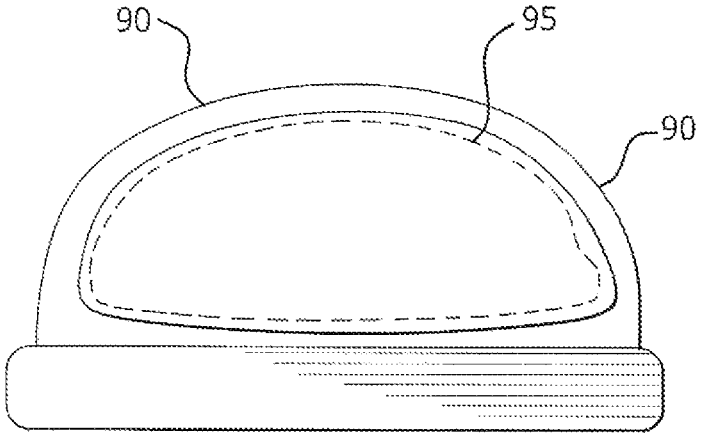
FIG. 5 is a schematic illustration of a three-dimensional scan of the cross-section of a shoe containing the shoe insert according to at least one embodiment of the invention taken at a position 3 cm from the end of the toe area of the shoe.
Figure 6:
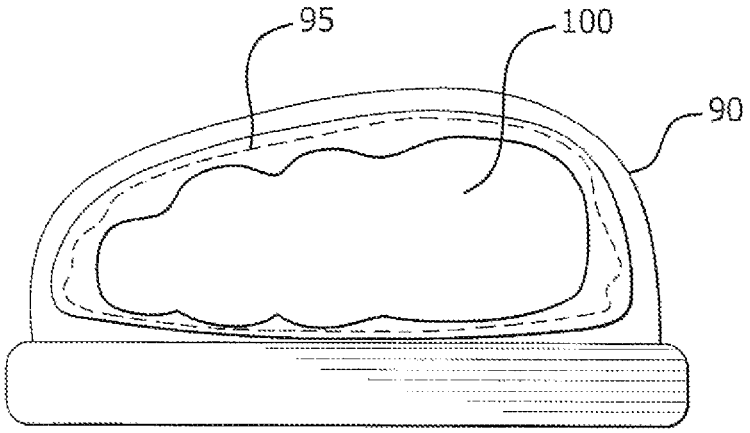
FIG. 6 is a schematic illustration of a three dimensional scan of the cross-section of the shoe depicted in FIG. 5 with an artificial foot insert positioned therein.
Figure 7:
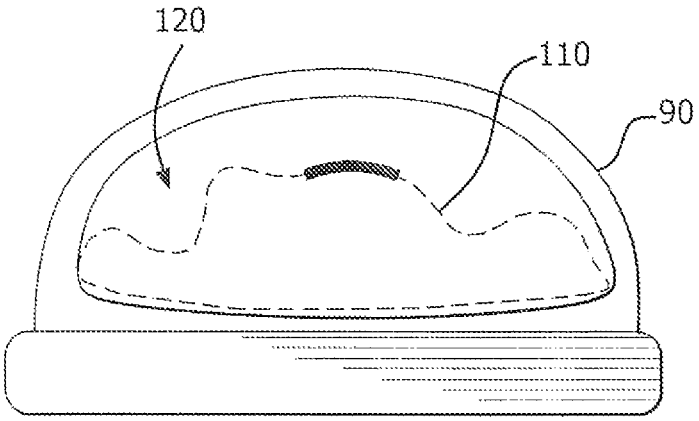
FIG. 7 Prior Art
FIG. 7 is a schematic illustration of a three-dimensional scan of the cross-section of a shoe containing a conventional shoe insert taken at a position 3 cm from the end of the toe area of the shoe.
Figure 8:
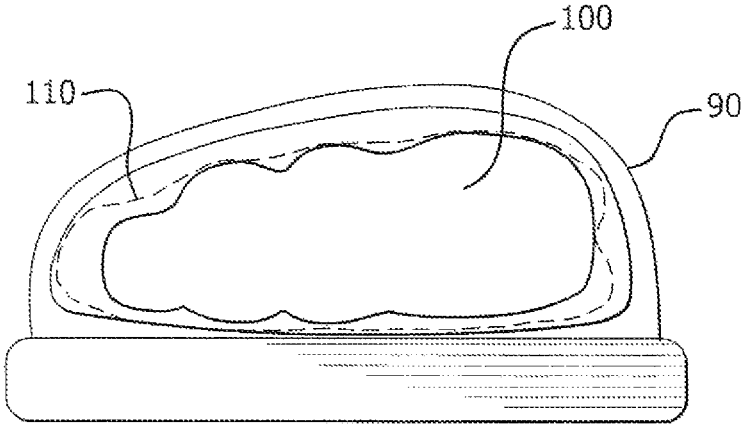
FIG. 8 is a schematic illustration of a three-dimensional scan of the cross-section of the conventional shoe depicted in FIG. 7 containing therein an artificial foot insert.

Additionally, the symmetrical last 80 minimizes and even avoids material stress peaks and subsequent membrane thinning and fracture during the formation of booties, socks, and shoe inserts that would result from a traditional asymmetrical foot-shaped last 85, such as is depicted in FIGS. 4A and 4B. Such a foot-shaped asymmetrical last is conventionally used in shoe construction processes contains distinctive left and right features and/or left and right foot designations. A symmetrical shoe insert with no left or right bias, such as is shown in FIGS. 3A and 3B, produces a suitable precursor for the subsequent thermal conformation processes taught herein.

Turning to FIG. 1, a schematic, cross-sectional view of a waterproof, breathable laminate 10 having a seamless, extensible film layer 20, an adhesive layer 40, and a textile layer 30 can be seen. In one exemplary embodiment, layer 20 may be an seamless, extensible polyurethane film, but other film materials described herein may also be employed. The terms "textile(s)" and "textile layer(s)" may be used interchangeably herein. In forming the laminate 10 of a 2-layer article, an adhesive 40 may be applied to one side of a textile 30, and the textile/adhesive composite may be positioned on a symmetrical last 80 with the adhesive side facing outwardly, i.e., away from the last. It is to be noted that positioning the textile on the symmetrical last 80 prior to applying the adhesive 40 to the textile 30 is within the scope of the invention. Alternatively, the adhesive 40 may be positioned on a side of an extensible film and the extensible film positioned such that the adhesive 40 faces the textile 30 on the symmetrical last 80.

The adhesive may be applied discontinuously or continuously, provided that breathability through the laminate is maintained. For example, an adhesive may be applied in the form of discontinuous attachments, such as by discrete dots or in a grid pattern, or in the form of an adhesive web to adhere the layers of the laminate together. Alternatively, a breathable adhesive may be applied in a continuous manner to form a layer of adhesive to adhere the layers of the laminate together. The adhesive may be a layer of a thermo-activatable adhesive where activation of the adhesive can be affected by a heating device. Although the use of adhesives is described herein with respect to joining (e.g., laminating) the textile layer to the extensible film, it is to be noted that any suitable process may be used, such as stitching, sewing, gluing, ultrasonic bonding, radio frequency welding, flame bonding, heat sealing gravure lamination, fusion bonding, spray adhesive bonding, and the like.

The textile used to form the booties, shoe inserts, and waterproof socks may be any textile that is air permeable and breathable and that has at least some elastic properties. Elastic, as used herein, is meant to denote that the material has stretch characteristics and can be tensioned; and, upon the release of tension, the material returns to its approximate original dimensions. When forming a sock, a textile having a high elasticity, or an elasticity of at least about 50%, at least about 75%, or at least about 100% or greater. The term "highly elastic" as used herein is meant to describe materials that have stretch characteristics and can be tensioned at least about 50% (or greater); and, upon the release of tension, the material returns to its approximate original dimensions.

The textile may be comprised of materials such as, but not limited, to cotton, rayon, nylon, polyester, silk, lycra, spandex, elastane, and blends thereof. The weight of the material forming the textile is not particularly limited except as required by the application. In some embodiments, the textile may impart sufficient abrasion resistance to the laminate to provide adequate protection for the wearer of the article of footwear. Also, the textile may have a soft hand so that the wearer of the footwear article is comfortable.

In exemplary embodiments, the textile is a commercially available sock or a textile tube (e.g., knitted or woven textile tube). The sock or textile tube may be formed of virtually any material or combination of materials as long as the sock or textile tube is elastic or has at least some elastic characteristics. In addition, the sock may be tubular or generally tubular in shape, or may have a formed shape that is generally in the shape of a foot. Such formed-shape socks may also have reinforced areas, such as in the toe and/or heel regions. The inclusion of heel and toe reinforcements results in the bootie and/or shoe insert having a more defined, foot-like shape. The bootie, shoe insert, and waterproof, breathable sock, may therefore have an upper portion, a heel portion, a toe portion, and a sole portion.

After the adhesive 40 is applied to either the textile 30 or to extensible film layer 20, or both, the extensible film is stretched over the symmetrical last 80. In exemplary embodiments, the symmetrical last 80 is attached to a rotatable arm and the last 80 is rotated to move the last 80 through the extensible film, which stretches the extensible film over the last 80 and into a seamless, extensible film 20 having the general three-dimensional shape of the symmetrical last 80. The adhesive may be a continuous breathable adhesive or a discontinuous adhesive. The extensible film may be held in a fixed orientation relative to the last 80 prior to moving the symmetrical last 80 through the extensible film. In addition, the extensible film may be pre-heated prior to conforming the extensible film over the last 80. It is to be appreciated that other mechanisms may be used to mechanically "push" or otherwise move the symmetrical last 80 through the extensible film. Alternatively, the extensible film may be manually stretched over the symmetrical last 80. At this stage in the process, the last 80 contains thereon the textile 30, adhesive 40, and the seamless, extensible film layer 20 (i.e., a 2-layer article).

An abrasion resistant coating may be applied to the extensible film 20 to protect the seamless, extensible film 20 from wear and/or damage. In a 2-layer article, an abrasion resistant coating may be applied to the extensible film 20. In use, the 2-layer article may be positioned such that the coating faces away from the foot (e.g., positioned towards the shoe) or it may be positioned such that the coating faces the foot of the wearer (i.e., positioned away from the shoe). An abrasion resistant coating may also or alternatively be applied to the surface of the textile. The 2-layer article may be positioned such that the coating faces either the shoe or the foot. It is to be appreciated that other coatings (e.g., colorants, oleophobic coatings, etc.) may be applied in addition to, or in place of, the abrasion resistant coating. The coating(s) may be applied to all or part of the surface(s) of the extensible film or to all or part of the surface(s) of the textile.

Figure 2:
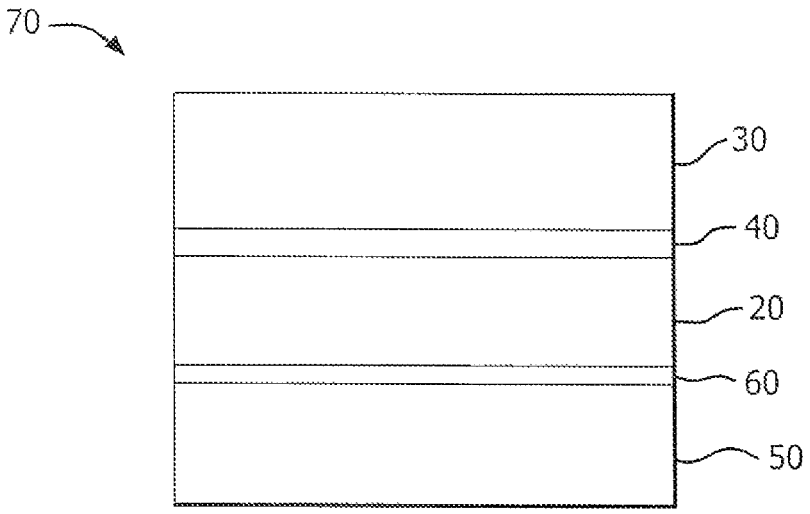
FIG. 2 is a schematic illustration depicting a cross section of a laminate forming a 3-layer shoe insert according to the present invention where two textile layers are utilized.

In forming laminate 70 shown in FIG. 2, a second adhesive 60 is applied to a second textile 50 and the second textile/adhesive composite is stretched over the symmetrical last 80 with the adhesive positioned on the exposed surface of the extensible film. Thus, the symmetrical last 80 has thereon the first textile 30, the first adhesive 40, a seamless, extensible film 20, the second adhesive 60, and the second textile 50 (i.e., the 3-layer article). It is to be understood that the textile layer 50 and adhesive layer 60 may be the same as, or different from, the textile layer 30 and adhesive layer 40 of laminate 10. Additionally, it is to be appreciated that laminates 10, 70 may contain any number of layers as long as the laminate meets the performance properties described herein.

In the 3-layer article an abrasion resistant coating may be applied to all or part of the surface of the first and/or second textile such that the coating faces the shoe (i.e., positioned away from the foot). The coating may also or alternatively be applied to all or part of the surface of the first and/or second textile such that the abrasion resistant coating faces the foot (i.e., away from the shoe). Other coatings may be applied in addition to, or in place of, the abrasion resistant coating.

The 2-layer article and the 3-layer article may form a bootie, shoe insert, or a sock, depending, at least in part, on the textile used to form the article. For example, and as discussed below, a tubular shaped sock may be used to form a waterproof sock whereas a reinforced, foot-shaped sock may be used to form a bootie or shoe insert.

The 2-layer article and the symmetrical last 80 or the 3-layer article and the symmetrical last 80, depending on the number of layers desired in the bootie and/or shoe insert, are heated to a suitable temperature (with or without vacuum) in a conforming step to set the seamless, extensible film 20 generally into the shape of the symmetrical last 80 and form a bootie. Accordingly, the bootie may be formed of an extensible film and at least one textile.

The temperature in the conforming step is ultimately dependent upon the adhesive(s) utilized, and should not be so high as to degrade and/or render useless any portion of the bootie, shoe insert, or waterproof sock described herein. Additionally, the conforming step adheres the textile layer(s) to the extensible film 20, particularly when a vacuum is utilized. The heating may occur in a conventional oven, an air circulating oven, or the like. It is to be appreciated that the 2-layer article or 3-layer article may be heated in the absence of the symmetrical last 80, or partially heated while positioned on the symmetrical last 80, with the remainder of the heating occurring in the absence of the symmetrical last 80 to conform the seamless, extensible film 20, so long as the 2-layer article or 3-layer article does not lose the general shape of the symmetrical last 80.

Regardless of the number of extensible film layers 20, textile layers 30, 50, or adhesive layers 40, 60 present in laminates 10, 70, the number of additional layers added, or the mechanism for bonding the materials together, the booties described herein will contain certain properties. For example, a bootie will be breathable. Additionally, the bootie is advantageously shapeable over a range of shoe sizes and shapes of lasts (e.g., left or right). Thus, booties according to the present invention can be manufactured as one size and be shrunk (or stretched) to fit a variety of shoe sizes, including men's, women's, and children's sizes.

After the bootie has been formed, it is removed from the symmetrical last 80 and loosely placed on a conventional asymmetrical last 85, which has left and right foot characteristics. The bootie and asymmetrical last 85 are then subjected to a shaping step where the bootie and asymmetrical last 85 are heated to an elevated temperature of generally about 130-150° C., or in a similar suitable range. The bootie and the asymmetrical last 85 may be heated in a conventional oven, an air circulating oven, or the like. During this thermal dwell, the bootie closely shapes to the shape and size of the conventional asymmetrical last 85, forming a smooth and close fitting shoe insert to that of the conventional last. The shoe insert on the conventional last 85 shows little-to-no wrinkles and has little, if any, excess material. After the heating is complete, the last 85 and shoe insert are removed from the heat and allowed to cool, generally to a temperature less than about 50° C. The shoe insert may then be removed from the last. The shoe insert may also be permitted to cool prior to removing the shoe insert from the asymmetrical last 85. The shoe insert is thus formed of a seamless, extensible shaped film with at least one textile.

In an alternate embodiment, the bootie is formed to have a size somewhat smaller than the size of the asymmetrical last 85, and is stretched to fit the asymmetrical last 85, with or without the application of heat, and optionally in a vacuum. It is to be appreciated that the bootie can be stretched to fit lasts over a large range of shoe sizes, such as from a woman's sized shoe last to a men's sized shoe last.

Figure 9:
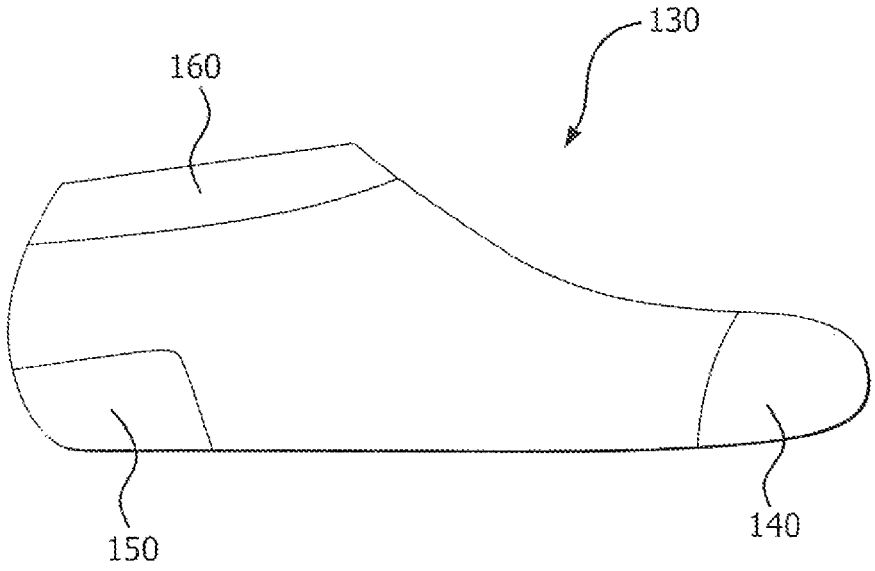
FIG. 9 is a schematic illustration of a heel and toe reinforced shoe insert.

The booties and shoe inserts may be self-supporting and maintain the three-dimensional shape of the last even after the shoe insert is removed from the last. By self-supporting, it is meant that the bootie or shoe insert (or waterproof, breathable sock described below) maintains an upright, substantially vertical orientation without any external support. By substantially vertical orientation, it is meant to describe a bootie or shoe insert that has an upright, vertical orientation or a nearly upright, vertical orientation. This is especially the case when a heel and/or toe reinforced sock is used to form the bootie and/or shoe insert. A schematic depiction of a heel and toe reinforced shoe insert is shown in FIG. 9. As shown, the shoe insert 130 has a toe-reinforced portion 140 and a heel-reinforced portion 150. The collar 160 and the upper portion 155 of the shoe insert 130 are also depicted to achieve a general depiction of the sock as a whole. It is to be noted that the lines drawn within the shoe insert 130 are to illustrate the general area that makes up the toe-reinforced portion 140, the heel-reinforced portion, and the collar 160, and it not to be construed as a seam of any kind.

Additionally, the thickness of the conformed or shaped film varies within the shoe insert, bootie, and waterproof sock (discussed below). Using the shoe insert 130 depicted in FIG. 9 merely as an illustrative example, the thickness of the shaped film measured at the heel portion 150 may be different than the thickness measured at the toe portion 140 of the shoe insert 130. Similarly, the thickness of the shaped film at the heel portion 150 may be different than the thickness measured at the upper portion 155 of the shoe insert 130.

The shoe insert may be used in the formation of footwear articles, such as shoes and boots. A shoe or boot containing the shoe insert may be formed in any manner known to those of skill in the art. It is to be noted that all standard and/or conventional methods of making and/or assembling footwear articles as known by those of skill in the art may be utilized, and are considered to be within the scope of the invention. For instance, molding pressing, gluing, stitching, fusion welding, fusion bonding, compression molding, upper bonding, ultrasonic welding, a well as any conventional or commercial tooling are considered to be within the purview of the invention.

In one embodiment, natural or synthetic upper materials may be stitched together to form a shoe upper. Toe and heel protectors may then be attached to the shoe upper. A shoe insert may then be attached to the shoe upper by stitching and/or adhering the shoe insert to the collar portion of the upper of the shoe. The synthetic upper materials and stitched/adhered shoe insert may then be then repositioned onto a conventional asymmetric last where a rubber adhesive is placed on the heel, toe, and sole areas. Any suitable adhesive, such as a solvent based chloroprene rubber adhesive, may be used as the adhesive. It is to be appreciated that a shoe may be made by placing the shoe insert into a shoe without any adhesive so that the shoe insert may be easily removed from the shoe if needed.

A protective layer, such as an ethylene vinyl acetate (EVA) layer, may be adhered to an additional component (e.g., an insole board) with the previously applied rubber adhesive. The protective layer may also, or alternatively, be attached to the sole of the shoe insert. The shoe upper may then be lasted around the shoe insert and attached additional component to form a close fitting shoe insert with the synthetic upper materials. Thus, the shoe insert fits very closely to the contour of the outer portions of the shoe. Finally, a sole (synthetic material, rubber, or other natural material) may be attached to the insole of the shoe insert using another adhesive, such as a solvent based polyurethane adhesive, to complete the waterproof, breathable shoe construction. Shoes made with the shoe insert are generally highly breathable, and may have a breathability of at least 3 g/hr, or greater. In one exemplary embodiment, the shoe or boot is made entirely formed of breathable component, thus making the shoe or boot breathable over its entirety. For example, a footwear article formed of an upper portion, a shoe insert, and a sole portion, each of the upper portion, shoe insert, and sole may be breathable.

In another exemplary embodiment, the seamless, extensible film may be used to form a waterproof, breathable sock. In particular, a 2-layer or 3-layer article may be made as described in detail above with the exception that the symmetrical last is typically smaller in size than the size of the symmetrical last used to make the bootie and shoe insert described above. The smaller symmetrical last allows the waterproof, breathable sock to maintain at least some elastic characteristics. In exemplary embodiments, the sock(s) utilized to form the waterproof, breathable sock are tubular socks or knitted or woven textile tubes that do not contain toe and heel reinforcements and contain some fibers with high elasticity. Generally, the sock or textile tube used to form the waterproof sock has a higher elasticity than the socks and textile tubes used to form the bootie and/or shoe insert, and may be "highly elastic" and have an elasticity of at least about 50%. It is to be appreciated that socks containing heel and/or toe reinforcements may be utilized to form a waterproof, breathable sock as long as the sock is highly elastic.

In some embodiments, the waterproof breathable sock is typically formed on a symmetrical last to provide conformed waterproof, breathable socks. Additionally, in some embodiments, the waterproof, breathable sock can undergo a shaping step in which the sock is shaped with the application of heat (e.g., in a conventional oven) on a conventional asymmetrical last to form a shaped waterproof, breathable sock. The waterproof, breathable socks typically have greater elasticity than booties or shoe inserts due, at least in part, to the elastic nature of the textile used (e.g. highly elastic sock or highly elastic textile tube). The waterproof, breathable socks may optionally have a breathability of at least 3 g/hr, or greater.

Figure 12:
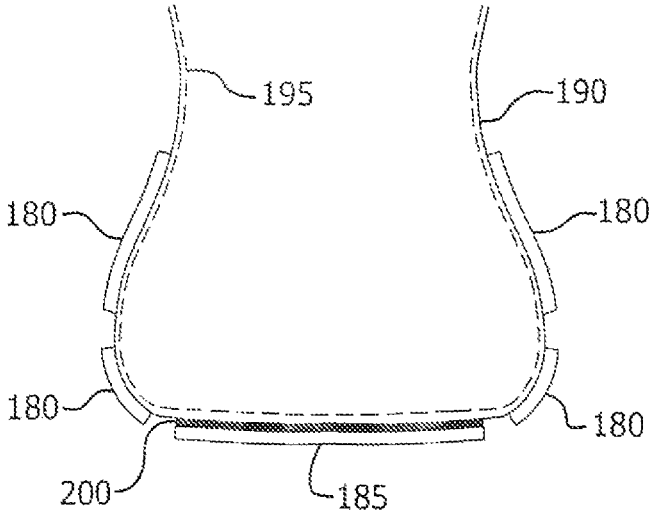
FIG. 12 is a cross-sectional schematic illustration of a shoe insert having thereon polymeric overlays.

In some embodiments, the bootie, shoe insert, or waterproof, or breathable sock may have thereon a polymeric overlay. The overlay(s) may be attached to the bootie, shoe insert, or waterproof, breathable sock by any suitable means such as, but not limited to, adhering, bonding, or stitching the overlay to the bootie or shoe insert. The application of a polymeric overlay (e.g. a thermoplastic or a thermoset material) may provide additional cushioning and/or support to the bootie, shoe insert, or waterproof, breathable sock. A shoe insert 190 with polymeric overlays 180, 185 is depicted schematically in FIG. 12. The polymeric overlays 180 provide both stability and support to the shoe insert 190. Polymeric overlay 185, which is positioned at the sole of the shoe insert 190, also provides protection to the wearer's foot (indicated by dashed line 195) and a gripping surface for the shoe insert 190. Polymeric overlays 180, 185 may be joined to the shoe (or bootie or waterproof, breathable sock) by any suitable attachment mechanisms, such as, but not limited to a seam 200. The inclusion of polymeric overlays may permit the "overlayed" shoe insert to be worn in an indoor or outdoor environment, without being part of a shoe. Similarly, the presence of a polymeric overlay(s) on a bootie or waterproof, breathable sock provides additional support and/or protection to the bootie or sock and may permit the bootie or sock to be worn in an indoor or outdoor environment without any other laminates or textiles attached thereto or without the bootie being inserted into a shoe.

It is to be appreciated that in an alternative embodiment, laminates 10, 70 may be pre-formed and subsequently and sequentially formed over symmetrical last 80 and asymmetrical last 85 and heated as discussed above to form the bootie and/or the shoe insert, and/or the waterproof, breathable sock.

In a separate embodiment, one or more laminate containing the seamless, extensible shaped film, such as, for example, laminate 10 or laminate 70, may be used to form a shoe insert. For example, appropriately sized and shaped laminate pieces may be joined at seamed portions to form a shoe inert. The seamed portions may then be rendered waterproof, such as by superimposing a waterproof sealant (e.g., a waterproof adhesive) or by applying a waterproof tape through a bonding or welding process. As one non-limiting example of forming a shoe insert, laminate 10 or 70 may be cut into appropriately sized and shaped pieces and joined to form an upper portion and a sole portion of a shoe insert. The upper portion and the sole portion may be joined in any conventional manner, such as by sewing, welding, or bonding the pieces together. The seams may then be rendered waterproof such as by applying the waterproof adhesive or tape discussed above. Prior to applying any waterproof adhesive or tape, the seamed, laminate shoe insert may be heated in a manner described above in a shaping step to conform to an asymmetrical last 85.

In another embodiment, the extensible film may be stretched over a conventional asymmetric last and formed into a shoe insert in a single step. The shoe insert (either with or without the asymmetrical last) may be heated to an elevated temperature, generally in the range of from about 130-150° C., or other suitable range, to reduce the ability of the extensible film to further stretch and/or to deform. The shoe insert of this embodiment is formed of a seamless, extensible film that has a shape substantially similar to the asymmetric last. In addition, the shoe insert may have one or more polymeric overlay thereon.

In yet another embodiment, a shoe insert having a generally symmetrical shape and which does not contain a textile is formed in a one step process. In this embodiment, the extensible film is stretched over a symmetrical last to form the shoe insert. The shoe insert (either with or without the symmetrical last) may be heated to reduce the ability of the extensible film to further stretch and/or to deform. The shoe insert of this embodiment is a seamless, conformed shoe insert having generally the shape of the symmetrical last. The shoe insert may have one or more polymeric overlay thereon.

In a further embodiment, the extensible film may be stretched over a conventional asymmetric last and made into a shoe insert in two steps (e.g. a conforming and a shaping step). In this particular embodiment, the shoe insert does not contain any textile. For instance, the extensible film may be stretched over a symmetrical last and heated to a temperature in a conforming step to create a seamless, extensible conformed film having a shape that is generally the shape of the symmetrical last and form a bootie. The bootie may then be positioned over an asymmetrical last and heated in a shaping step to shrink the extensible film to fit the asymmetrical last and form a shoe insert. The seamless, extensible shaped film may have a coating thereon, such as, for example, to render the membrane hydrophobic, oleophobic, dimensionally stable, and/or abrasion resistant. Thus, a shoe insert may be made entirely of a seamless, extensible shaped film. In addition, the shoe insert may have one or more polymeric overlay thereon.

Similarly, a waterproof, breathable sock made entirely of a seamless, extensible film may be formed by not subjecting the seamless extensible film to the shaping step. Such a waterproof, breathable sock has a shape substantially similar to the symmetric last. It should be appreciated, however, that shaped waterproof, breathable socks are within the scope of the present invention, as described elsewhere herein.

In a further embodiment, the extensible film may be stretched over a symmetric last and formed into a bootie in a single step. The bootie (either with or without the symmetrical last) may be heated to reduce the ability of the extensible film to further stretch and/or to deform. The bootie is thus formed of a seamless, extensible conformed film that has a shape substantially similar to the symmetric last. The bootie may have thereon one or more polymeric overlay.

In another embodiment, a bootie or shoe insert may be formed by positioning a textile/adhesive composite on a symmetrical or an asymmetrical last as described in detail above. Next, a laminate including extensible film, a second adhesive, and a second textile may be formed. The bootie or shoe insert may be formed by stretching the laminate over the textile/adhesive composite. Additional heating steps as described herein may be conducted to finish forming the bootie or shoe insert.

The booties, shoe inserts, and waterproof, breathable socks described above have continuous, seamless layer(s) of polyurethane. In other words, each conformed or shaped extensible film in the bootie, shoe insert, or shoe insert is formed of a single conformed or shaped extensible film. As such, there are no seams in the conformed or shaped extensible film within the booties, shoe inserts, and waterproof, breathable socks. Shoes formed with the shoe inserts are therefore more comfortable to wear, particularly when compared to conventional shoe inserts formed with seamed portions where laminate pieces are attached to each other. As discussed herein, the shoe inserts having therein seamless, extensible films do not form or contain, or only minimally form or contain, folds, wrinkles, or seams that would ultimately compromise the breathability and/or fit of the shoe insert in the shoe.

Figure 10:
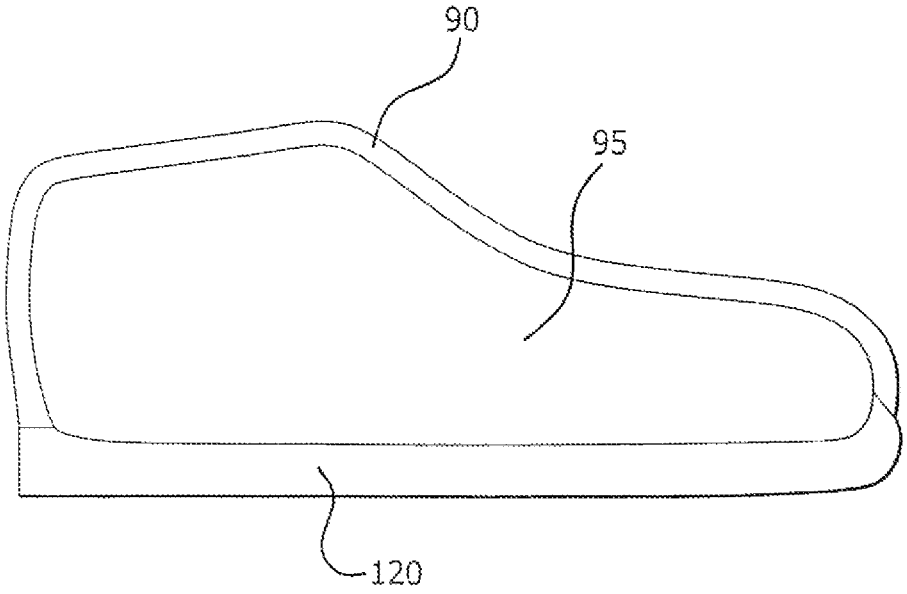
FIG. 10 is a schematic illustration of a cross-section of a shoe insert within a shoe comprising an upper and a sole.

Additionally, booties, shoe inserts, and waterproof, breathable socks having a seamless, extensible conformed or shaped film described herein are breathable over the entirety of the bootie, shoe insert, or waterproof, breathable sock, which is at least partially due to the breathable laminate forming the bootie, shoe insert, or waterproof, breathable sock and the lack of seams in the conformed or shaped film. For example, for a shoe insert having an upper portion, a heel portion, a toe portion, and a sole portion, each of these portions may be breathable. A cross sectional schematic view depicting the shoe insert 95 positioned within a shoe containing a shoe upper 90 and a sole 120 is depicted in FIG. 10. It is to be noted that a shoe insert with a seamless, extensible shaped film closely follow the contours of the shoe, leaving little to no space or air gaps between the shoe insert and the shoe.

A second component may be attached to the bootie, shoe insert, or waterproof, breathable sock to form a hybrid bootie, hybrid shoe insert, or hybrid sock. The second component may provide a different function or feature and/or it may be formed of a different material from the bootie, shoe insert, or waterproof, breathable sock. The additional component may be, for instance, a textile, a laminate (e.g., a laminate including a polymer membrane), a textile laminate, a polymer membrane, or a second conformed or shaped film different from the first conformed or shaped film (e.g., having a characteristic or property different from the first conformed or shaped film) in the bootie, shoe insert, or waterproof, breathable sock. The selection of the second component is not particularly limited, and may be chosen depending on the desired quality or property. It is to be appreciated that the second component(s) may be used, for example, to tailor the bootie, shoe insert, or waterproof, breathable sock to achieve desired properties and/or a desired appearance. The second component may be attached to the bootie, shoe insert, or waterproof, breathable sock by any conventional joining or attaching method. Non-limiting examples of such methods include stitching, sewing, gluing, ultrasonic bonding, radio frequency welding, flame bonding, and heat sealing lamination, fusion bonding, spray adhesive bonding, and the like. Further, it is to be noted that the terms "second component" and "second material" may be used interchangeably herein.

Figure 14:
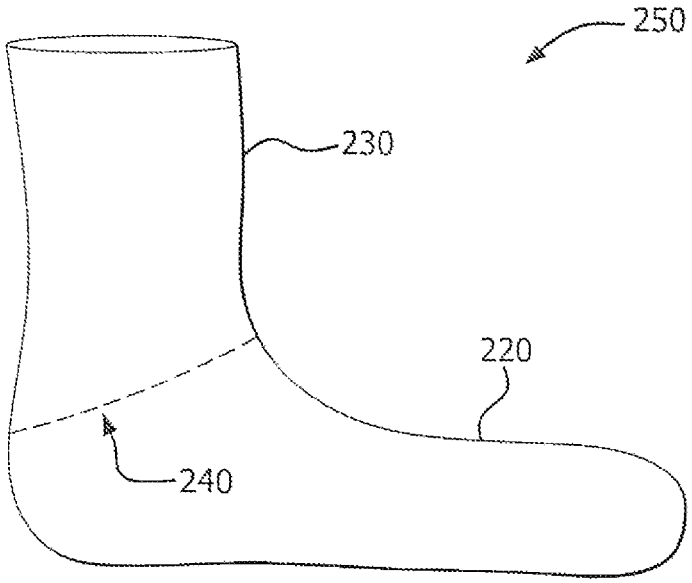
FIG. 14 is a cross-sectional schematic illustration of a hybrid shoe insert.

One example of a hybrid shoe insert 250 is depicted in FIG. 14. The depicted hybrid shoe insert 250 includes a shoe insert 220 attached to a second component 230 (e.g., a textile, a laminate, a textile laminate, a polymer membrane, or a second shaped film) by a seam 240, although, as discussed above, any method for joining the shoe insert 250 to the second component 230 may be utilized. The hybrid shoe insert 250 illustrated in FIG. 14 may be used in the formation of a boot, or in a situation where a portion located above the shoe insert 220 needs (or is desired) to have a functionality or feature that is different from what is provided by the shoe insert 220. It is to be appreciated that any number of portions or seams within the hybrid shoe insert as well as any number of positions for the seams, is considered to be within the purview of the invention.

Figure 11:
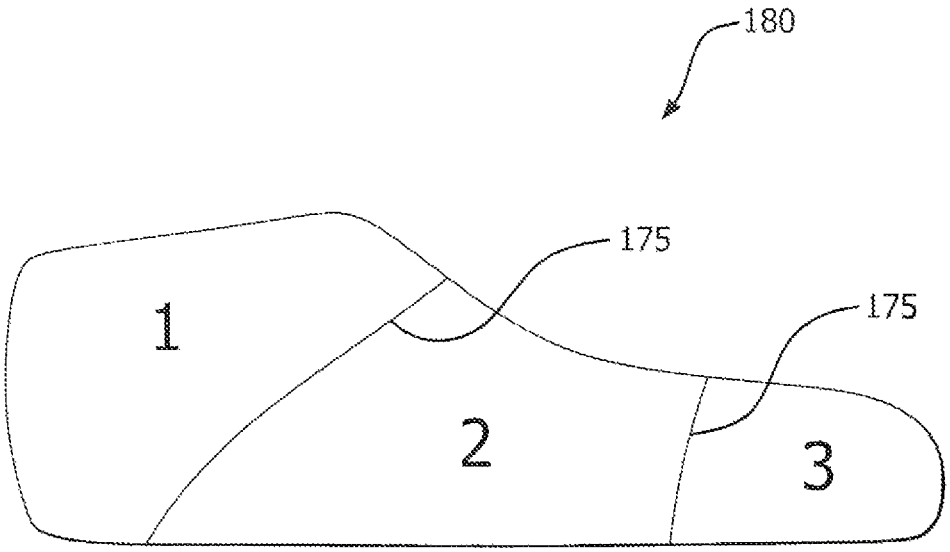
FIG. 11 is a schematic illustration of a hybrid shoe insert according to one exemplary embodiment of the present invention.

One embodiment containing various portions or regions within a shoe insert is depicted in FIG. 11. The conformed/shaped film and textile(s) forming the shoe insert may be cut and portion(s) removed therefrom. The portion(s) removed may then be replaced by one or more second component. In another embodiment, the portion that is removed may be attached to at least one second component. The second materials may possess differing characteristics, such as, for example, different breathability and/or different waterproofness and/or different aesthetic appearances. In one or more embodiment, seams may be rendered waterproof by sealing the seams with a waterproof tape (e.g., GORE-SEAM® tape (available from W. L. Gore and Associates, Inc.). It is to be appreciated that the bootie containing one or more seams in FIG. 11 is merely illustrative, and one or more seam may be utilized in the socks and booties described herein in a similar manner.

In FIG. 11, the shoe insert contains two seams 175, which creates three separate "zones" or "regions" (illustrated as 1, 2, and 3, respectively) within the shoe insert. For example, zone 1 may contain the portioned shoe insert, and zones 2 and 3 may each contain a second component. Alternatively, zone 2 shown in FIG. 11 may contain the portioned shoe insert and zones 1 and 3 may each contain a second material. It is to be appreciated that any combination of shoe insert portion(s) and second component(s) are within the purview of the invention. It is also to be understood that any number of zones (and seams) may be present in a hybrid bootie, hybrid shoe insert, or hybrid waterproof, breathable sock, and that such embodiments are considered to be within the purview of the invention. Additionally, the joining mechanisms (e.g., stitching or gluing) may be positioned in locations where the joining mechanism is not likely to interfere with the comfort of the person donning the bootie, shoe insert, or sock.

Figure 13:
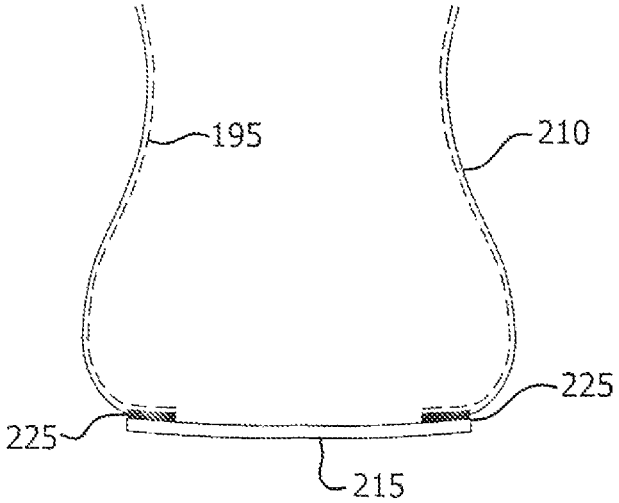
FIG. 13 is a cross-sectional schematic illustration of a partial shoe insert attached to an insole board.

In another embodiment, portions of the shoe inserts described herein may be used in shoe construction. For instance, the sole (bottom portion) of a shoe insert may be removed and the partial shoe insert (e.g. upper portion of the shoe insert) may be attached to an additional component (e.g. insole board), such as is depicted schematically in FIG. 13. Specifically, FIG. 13 depicts a partial shoe insert 210 (with the sole removed) adhered to an insole board 215 via an adhesive 225. It is to be appreciated that any suitable process for joining the partial shoe insert to the additional component may be used, such as stitching, sewing, gluing, ultrasonic bonding, radio frequency welding, flame bonding, and heat sealing gravure lamination, fusion bonding, spray adhesive bonding, injection molding, and the like. It is to be understood that any portion or part of the bootie or shoe insert may be removed, including removal of one or more layers of the laminate such as by skiving, and that such partial booties and partial shoe inserts are considered to be within the scope of the invention.

Figure 15:
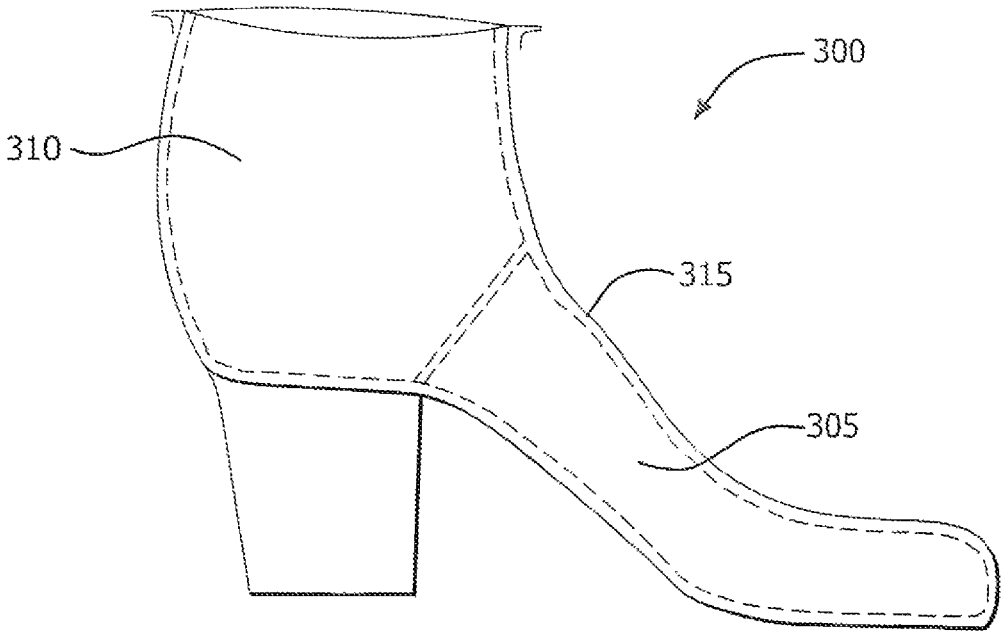
FIG. 15 is a cross-sectional schematic illustration of a hybrid shoe insert position in a woman's dress shoe.

A hybrid shoe insert may be utilized in both men's and women's shoes. One example of a hybrid shoe insert utilized within a woman's shoe is schematically depicted in FIG. 15. In this embodiment, the hybrid shoe insert contains a shoe insert portion 305 and a second component portion 310. Both the shoe insert portion 305 and the second component portion 310 are located within a shoe 300, as depicted by the dashed lines. In this example, the component portion 310 may be formed of a textile, for example, for ease comfort when wearing the shoe 300. Similar to the shoe inserts described above, hybrid shoe inserts fit very closely to the contour of the outer portion 315 of the shoe 300.

It is to be appreciated that although seams are referenced herein with respect to hybrid shoe inserts any of the booties, shoe inserts, or waterproof, breathable socks described herein may contain at least one seam as described above. Any number of seams, as well as any number of regions formed by the seams, are considered within the scope of the invention.

Figure 16:
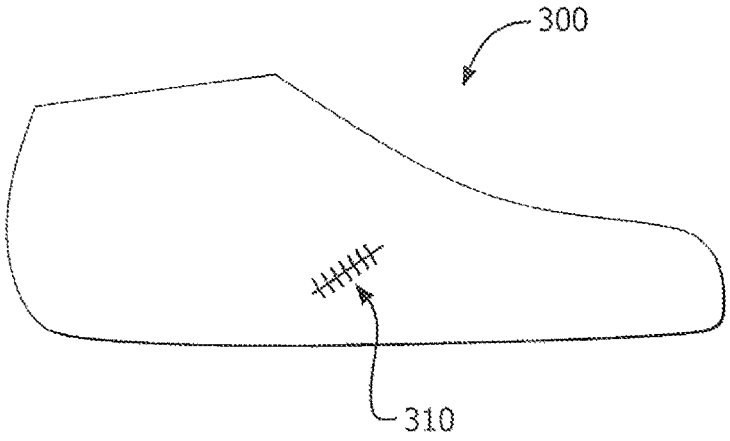
FIG. 16 is a cross-sectional schematic illustration of a shoe insert having therein a tear in the extensible film that has been repaired by stitching the extensible film together.
Figure 17:
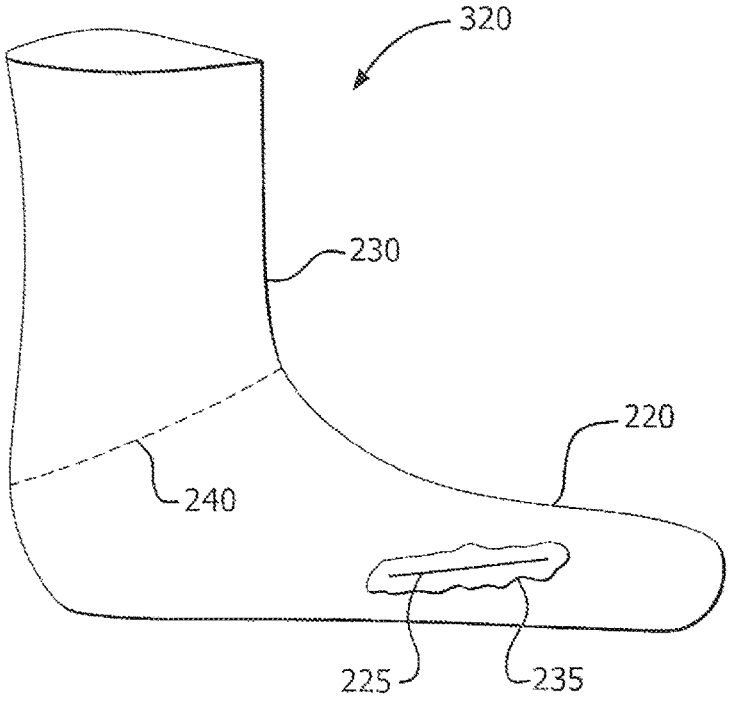
FIG. 17 is a cross-sectional illustration of a hybrid shoe insert having therein a cut that has been repaired by gluing the extensible film.

In some instances, the seamless conformed or shaped film may be cut, slit, torn, punctured, or otherwise damaged, either during the manufacturing of the bootie, shoe insert, or waterproof, breathable sock or after the bootie, shoe insert, or sock has been made. In a situation where the seamless conformed or shaped film becomes discontinuous (such as where the conformed or shaped ePTFE membrane is damaged or torn), the conformed or shaped film may be joined (e.g., repaired) by attaching the conformed or shaped film to itself at an integrally joined interface. In one exemplary embodiment shown in FIG. 16, a shoe insert 300 containing a shaped film having a cut or tear therein may be joined (e.g., stitched) together at an integrally joined interface 310. In another exemplary embodiment depicted in FIG. 17, a tear may be present in the shaped film in a hybrid shoe insert 320 containing a shoe insert portion 220 and a second component 230 joined at seam 240. The shaped film may be joined to itself at an integrally joined interface 225 by an adhesive 235. In a further embodiment, the film may be folded at an integrally formed interface for aesthetic reasons, such as to form a pleat or tuck.

Figure 18:
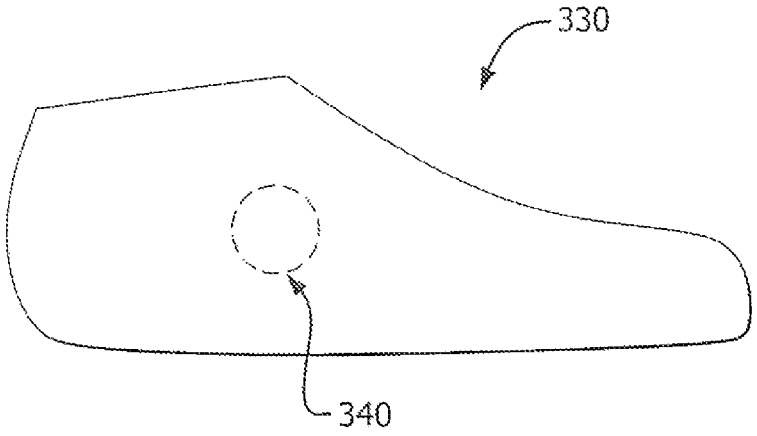
FIG. 18 is a cross-sectional illustration of a shoe insert where a damaged section of the shoe insert has been repaired by placing a patch on the shoe insert.

In a further embodiment, a tear or other damage in a seamless conformed or shaped film may be repaired by utilizing a patch, such as is shown in FIG. 18. In FIG. 18, damage to the shaped film in the shoe insert 330 has been repaired by positioning a patch 340 over the damaged area. The patch may be adhered, stitched, or otherwise affixed to the shoe insert 330. It is to be appreciated that a shoe inserts containing a damaged shaped film are merely illustrative, and one or more integrally joined interface may be utilized in the booties and socks described herein in a similar manner.

In yet another embodiment, an elastic or at least partially elastic tubular textile may be utilized to form a sock by applying an adhesive to the tubular textile and positioning the tubular textile/adhesive composite on a symmetrical last with the adhesive positioned outwardly, away from the symmetrical last. The symmetrical last may then be pushed through the extensible film to position the extensible film on the tubular textile. The tubular textile with the extensible film thereon may be seamed at the toe portion to form a sock.

In a further embodiment, the extensible film may be densified by any conventional method. Booties, shoe inserts, and socks may be formed with such densified film; however, the booties, shoe inserts, and socks made from the densified film would not be breathable. The densified film provides protection against aggressive environments, such as, but not limited to, exposure to hazardous chemicals or biological threats.

As is evident from the figures and text presented above, a variety of embodiments are contemplated. Exemplary embodiments are described further herein.

E1. A footwear article, such as a bootie, shoe insert, or sock, comprising a seamless conformed polyurethane film having a first side and a second side.

E2. The embodiment of E1, wherein the seamless conformed polyurethane film has a three dimensional configuration of a symmetrical last or portion thereof.

E3. The embodiment of any of E1-E2, wherein a first textile joined to said first side of said polyurethane film, and wherein said seamless conformed polyurethane film and said textile form a laminate.

E4. The embodiment of any of E1-E3, wherein a first textile joined to said first side of said polyurethane film, and wherein said seamless conformed polyurethane film and said textile form a laminate.

E5. The embodiment of any of E4, wherein a second textile is positioned adjacent said polyurethane film opposing said first textile, and wherein said seamless conformed polyurethane film, said first textile, and said second textile form a laminate.

E6. The embodiment of any of E1-E5, wherein said first textile forms an interior portion of the bootie, and said second textile forms an exterior portion of said bootie.

E7. The embodiment of any of E1-E6, wherein at least one of said polyurethane film, said first textile, and said second textile has at least one additional layer thereon.

E8. The embodiment of any of E1-E7, wherein said at least one additional layer is an abrasion resistant coating.

E9. The embodiment of any of E1-E8, wherein said at least one additional layer is an oleophobic coating.

E10. The embodiment of any of E1-E9, wherein said polyurethane film has a thickness variation from a first location in said bootie to a second location in said bootie.

E11. The embodiment of any of E1-E10, wherein at least one of said first textile and said second textile have at least some elastic properties.

E12. The embodiment of any of E1-E11, wherein said first textile and said second textile are selected from the group consisting of a knitted textile tube, a woven textile tube, a tubular sock and a formed sock.

E13. The embodiment of any of E1-E12, wherein at least one of said first textile and said second textile is a sock having a heel portion, a toe portion, and a body portion positioned there between, and wherein at least one of said heel portion and said toe portion is reinforced.

E14. The embodiment of any of E1-E13, wherein said bootie is waterproof and breathable.

E15. The embodiment of any of E1-E14, further comprising at least one polymeric overlay on said bootie.

E16. The embodiment of any of E1-E15, further comprising an adhesive positioned on at least one of said polyurethane film, said first textile, and said second textile.

E17. The embodiment of any of E1-E16, wherein said bootie has a moisture vapor transmission rate of at least 3 g/hr.

E18. The embodiment of any of E1-E17, further comprising at least one second component attached to said polyurethane film, said laminate or a portion thereof.

E19. The embodiment of E18, wherein said at least one second component creates regions in said bootie, at least one of said regions possessing a function or feature different from another said region.

E20. The embodiment of E18, wherein said at least one second component is selected from the group consisting of a textile, a second component laminate, a textile laminate, a polymer membrane, or a second polyurethane film different from said conformed polyurethane film.

E21. The embodiment of E18, wherein said second component laminate and said textile laminate include a polymer membrane.

E22. The embodiment of any of E1-E21, wherein a portion of said laminate is removed and said portion is affixed to at least one second component.

E23. The embodiment of any of E1-E22, wherein a portion of said laminate is removed and at least one second component replaces said removed portion.

E24. The embodiment of any of E1-E23, further comprising an adhesive positioned on at least one of said polyurethane film, said first textile, and said second textile.

E25. The embodiment of E24, wherein said adhesive is a discontinuous adhesive.

E26. The embodiment of claim E24, wherein said adhesive is a continuous breathable adhesive.

E27. The embodiment of any of E1-E24, wherein at least one of said polyurethane film and said first and second textiles has thereon a discontinuous adhesive; and wherein at least one of said polyurethane film and said first and second textiles has thereon a continuous breathable adhesive.

E28. A footwear article, such as a bootie, shoe insert, or sock, comprising a seamless shaped polyurethane film having a first side and a second side.

E29. The embodiment of E28, wherein the seamless shaped polyurethane film has a three dimensional configuration of an asymmetrical last or portion thereof.

E30. A method of forming a seamless bootie comprising: applying a first adhesive on one of (1) a side of a first textile or (2) a side of a conformable polyurethane film having an elongation at break value of 500% or more in at least one direction; positioning said first textile on a symmetrical last; and stretching said conformable polyurethane film over said first textile and said symmetrical last, wherein the adhesive is between the first textile and the polyurethane film, to form a first seamless composite comprising a conformed polyurethane film, said adhesive, and said textile.

E31. The embodied method of E30, wherein said first seamless composite forms a seamless bootie.

E32. The embodied method of E30, further comprising positioning a second composite comprising a second adhesive and a second textile on said first composite such that said second adhesive is positioned on said conformed polyurethane film to form a seamless bootie; and heating said seamless bootie and said symmetrical last to a temperature from about 130 to about 150° C.

E33. The embodied methods of any of E30-E32, wherein said bootie has a generally symmetrical shape.

E34. The embodied methods of any of E30-E33, further comprising: applying pressure or vacuum to said bootie.

E35. The embodied methods of any of E30-E34, wherein said stretching step comprises: positioning said polyurethane film over said symmetrical last; and rotating said symmetrical last through said polyurethane film to form said bootie.

E36. The embodied methods of any of E30-E35, further comprising positioning at least one polymeric overlay on said bootie.

Test Methods

It should be understood that although certain methods and equipment are described below, any method or equipment determined suitable by one of ordinary skill in the art may be alternatively utilized.

Conformability Assessments

To assess the conformability of the shoe insert in the formed shoe, the surface of the inner shoe can be felt by hand to determine any folds, wrinkles or seams that would ultimately compromise comfort fit. In addition, the shoes can be scanned using a scanning device to visually determine the presence or absence of air gaps to indicate how closely the shoe insert fits to the upper shoe materials.

Whole Boot Moisture Vapor Transmission Rate Test

The Whole Boot Moisture Vapor Transmission Rate for each sample was determined in accordance with the Department of Defense Army Combat Boot Temperate Weather Specifications. The specifications are as follows:

Whole Boot Breathability

The boot breathability test shall be designed to indicate the Moisture Vapor Transmission Rate (MVTR) through the test sample by means of a difference in concentration of moisture vapor between the interior and the exterior environment.

Apparatus a. The external test environment control system shall be capable of maintaining 23 (±1)° C. and 50%±2% relative humidity throughout the test duration.

b. The weight scale shall be capable of determining the weight of test samples filled with water to an accuracy of (±0.01) gram.

c. The water holding bag shall be flexible so that it can be inserted into the test sample and conform to the interior contours; it must be thin enough so that folds do not create air gaps; it must have much higher MVTR than the footwear product to be tested; and it must be waterproof so that only moisture vapor contacts the interior of the footwear product rather than liquid water.

d. The internal heater for the test sample shall be capable of controlling the temperature of the liquid water uniformly in the test sample to 35 (±1)° C.

e. The sealing method around the collar of the test sample shall be impervious to both liquid water and water vapor.

Procedure a. Place sample in test environment and condition for at least 12 hours.

b. The heating device is inserted into the water holding bag and the complete assembly is then placed into the test sample opening and filled with water to a height of 5 cm measured from inside sole.

c. Seal opening around the collar with plastic wrap around the top of the footwear and tape over using packaging tape.

d. Heat water in test sample to 35° C.

e. Weigh test sample and record as Wi.

f. Hold temperature in test sample after weighing for a minimum of 4 hours.

g. After a minimum of 4 hours, reweigh test sample. Record weight as Wf and test duration as Td.

h. Calculate MVTR of the test sample in grams/hour from the equation below:

$$MVTR=(Wi-Wf)/Td$$

Shoe and Shoe Insert Centrifuge Waterproofness Tests (1) Waterproofness for each shoe sample was determined by use of the Centrifuge test described in U.S. Pat. No. 5,329,807 to Sugar, et al. assigned to W.L. Gore and Associates, Inc. and incorporated by reference herein in its entirety. The centrifuge tests were carried out for 30 minutes. The shoe sample was considered to be waterproof if no leakage was seen after 30 minutes.

(2) Waterproofness for the 2-layer bootie samples and shoe insert samples (bootie after thermally conforming to a 265 sized running shoe last) was determined by a modified Centrifuge test described in U.S. Pat. No. 5,329,807 to Sugar, et al. assigned to W.L. Gore and Associates, Inc. To ensure accurate waterproof testing of socks, 800 mls of water was added to each sample which was then secured on a fixture using hose clamps around the rim of the upper heel area of the sock. The centrifuge tests were carried out for 60 minutes. The sample was considered to be waterproof if no leakage was seen after 60 minutes.

Sock Moisture Vapor Transmission Rate Test

The Moisture Vapor Transmission Rate for each sock was determined in accordance with Department of Defense Army Combat Boot Temperate Weather Specification with the exception that a sock was used as the test sample. The specifications were as follows:

The sock breathability test shall be designed to indicate the Moisture Vapor Transmission Rate (MVTR) through the sock by means of a difference in concentration of moisture vapor between the interior of the sock and the exterior environment of the sock.

Apparatus.

a. The external test environment control system shall be capable of maintaining 23 (±1)° C. and 50%±2% relative humidity throughout the test duration.

b. The weight scale shall be capable of determining the weight of test samples filled with water to an accuracy of (±0.01) gram.

c. The water holding bag shall be flexible so that it can be inserted into the test sample and conform to the interior contours; it must be thin enough so that folds do not create air gaps; it must have much higher MVTR than the footwear product to be tested; and it must be waterproof so that only moisture vapor contacts the interior of the footwear product rather than liquid water.

d. The internal heater for the test sample shall be capable of controlling the temperature of the liquid water uniformly in the test sample to 35 (±1)° C.

e. The sealing method around the collar of the test sample shall be impervious to both liquid water and water vapor.

Procedure.

a. Place sample in test environment and condition for at least 12 hours.

b. The heating device is inserted into the water holding bag and the complete assembly is then placed into the test sample opening and filled with water to a height of 5 cm measured from inside sole.

c. Seal opening around the collar with plastic wrap around the top of the footwear and tape over using packaging tape.

d. Heat water in test sample to 35° C.

e. Weigh test sample and record as Wi.

f. Hold temperature in test sample after weighing for a minimum of 4 hours.

g. After a minimum of 4 hours, reweigh test sample. Record weight as Wf and test duration as Td.

h. Calculate MVTR of the test sample in grams/hour from the equation below:

$$MVTR=(Wi-Wf)/Td$$

As a further modification and to represent the sock moisture vapor transmission rate when the sock is worn in a shoe, the moisture vapor transmission rate tests were repeated with the socks placed in a large size running shoe taking care to minimize air gaps. The same running shoe was used in each test and was dried using a hot air drier between tests. Throughout the tests, the total weight of the sock and shoe was measured to determine water vapor transmission rates.

A running shoe was made with synthetic upper materials (part number DMT20130502, commercially available from Dong Min Textile, 3173-24, Mungji-Dong, Gangseo-Ku, Busan, Korea). The synthetic upper materials of the shoe were stitched together to form the upper of the shoe. Toe and heel protectors were then attached to the upper of the shoe. A 6 oz canvas toe puff (commercially available from Dae Kyung Tex Co. #C-135 Gamjeon-dong Sasang-Gu, Busan, Korea) and a Rhenoflex 3105 heel counter having a thickness of 1.6 mm (commercially available from Rhenoflex, Giulinistrasse 2 67065 Ludwigshafen, Germany) were obtained and attached to the upper of the shoe. No liner materials were added.

The upper materials were then repositioned onto a large sized running shoe last and a solvent based chloroprene rubber adhesive was placed on the heel and toe areas (8250 supplied by Henkel Technologies Korea, 604-030, 472 Shinpyung-Dong, Saha-Ku, Busan, Korea) and sole (8700H supplied by Henkel Technologies Korea, 604-030, 472 Shinpyung-Dong, Saha-Ku, Busan, Korea) area. A protective EVA layer (2.0 mm, hardness 55 supplied by Dong Bo S.M. Co., Ltd #520-36 Gouebob-dong Sang-Gu, Busan, Korea) was adhered to a non woven insole board (1.4 mm supplied by Han Young Industry Co., Ltd, #394-5 Samrak-dong Sang-Gu, Busan, Korea) using a solvent based chloroprene rubber adhesive (8700H supplied by Henkel Technologies Korea, 604-030, 472 Shinpyung-Dong, Saha-Ku, Busan, Korea). The upper materials were then lasted around the attached insole board, as known in the art to form a close fitting liner with the upper materials. Finally, a rubber sole was attached to the insole board using a solvent based polyurethane adhesive (6190S, part number ZY30204093) available from Henkel Technologies Korea, 604-030, 472 Shinpyung-Dong, Saha-Ku, Busan, Korea to complete the shoe construction.

Sock Centrifuge Waterproofness Test

Waterproofness for each sock test sample was determined by use of the Centrifuge test described in U.S. Pat. No. 5,329,807 to Sugar, et al. assigned to W.L. Gore and Associates, Inc. To ensure accurate waterproof testing of socks, 700 mls of water was added to each sock test sample which was then secured on a fixture using hose clamps around the rim of the upper heel area of the sock. The centrifuge tests were carried out for 60 minutes. The sock test sample was considered to be waterproof if no leakage was seen after 60 minutes.

Elongation/Elasticity of Bootie

Elongation/Elasticity of the bootie, may be measured according to DIN EN 14704-1 (July 2005), method A. The test may carried out as set out therein, while using test samples of the following configuration: Test sample width=25 mm, test sample testing length=50 mm (testing length refers to the free length of the test sample in between the clamps on its opposite side), whole length of test sample=100-150 mm. The test sample is subjected to 3-5 consecutive test cycles. In each test cycle, the test sample is subject to a constant extension of at least 30% of said gauge length, in samples cut circumferentially and at least 10% of said gauge length in samples cut longitudinally to the formed bootie, and the maximum force of the last cycle is measured. The extension and retraction rate of the sample should be set to 250 mm/min. The specimen length is measured after final cycle finishes by laying it on a flat surface and measuring the length between applied reference markers within the gauge length with a calibrated ruler. The elastic recovery expressed in % is calculated through subtracting the final length between applied reference markers from the original length between said reference markers, dividing then by the original length between said reference markers, and finally multiplying the result by 100. Otherwise, test conditions are as set out in DIN EN 14704-1 (July 2005), method A. Elasticity is defined as a property of material in which the material extends at the application of a force or extension and recovers to its original length after removing the applied force or extension. The elasticity of the specimen is therefore determined via measuring the force recorded during applied extension (or vice versa) and the ability of the material to recover to its original length after said applied force or extension has been removed.

Elongation of Film

The elongation of the film may be measured according to ASTM D 638 (2003). The elongation of the film is prior to being made into the three dimensional last. This test method covers the determination of the minimum elongation at break properties of films in the form of standard dumbbell-shaped test specimens when tested under defined conditions of pretreatment, temperature, humidity, and testing machine speed. This test method is suitable for testing films of any thickness up to 14 mm. INSTRON® Tensile Tester Model No. 5564 equipped with an extensometer and 500 Newton load cell may be used for the test along with a software package used to operate the tester, such as Merlin, Version 4.42 (Instron Corporation, Norwood, Mass.). The minimum elongation at break may be determined by the load and extension at the moment of rupture.

EXAMPLES

Example 1

A symmetrical polyetherimide foot last was fixed onto a supporting clamp. A polyurethane adhesive web (UT8, 20 g/m$^2$ polyurethane non-woven hot melt adhesive commercially available from Protechnic, 41 Avenue Montaigne, F-68700, Cernay, France) was applied to one side of a 70 denier 100% black polyamide sock using a heat press of dimensions 35.6 cm in width and 45.7 cm in length set at 130° C. for 15 seconds and a pressure of 16 psi. The sock with the polyurethane adhesive web thereon was positioned tightly over the foot last. The sock was applied to the last with the adhesive web exposed on the outer surface of the last. Care was taken when applying the sock to the last to avoid wrinkles. A 21 cm width and 30 cm length sheet of breathable polyurethane film HSLEU28 (available from Smith & Nephew Extruded Films Limited, Broad Lane, Gilberdyke, East Yorkshire, HU15 2TD, United Kingdom) with an elongation at break of 650% in both directions was conformed by hand over the foot last until the film had reached above the ankle height of the foot last. The conformed film was then held in place using an elastomeric ring around the ankle area. A second 70 denier 100% black polyamide sock again having thereon a polyurethane adhesive web (UT8, 20 g/m$^2$ polyurethane non-woven hot melt adhesive commercially available from Protechnic, 41 Avenue Montaigne, F-68700, Cernay, France) was then placed over the conformed breathable polyurethane film with the polyurethane adhesive positioned in direct contact with the surface of the conformed polyurethane film.

The complete assembly containing the 3-layer article (sock/conformed polyurethane film/sock) and the symmetrical polyetherimide last was then placed in an oven set at 140° C. for a time of 30 min. The assembly was then removed and a vacuum bag was quickly applied over the assembly. A vacuum was applied at 20-25 inches Hg for 20 minutes to ensure good contact between the three separate layers and to allow for subsequent adhesive bonding between the socks and the conformed polyurethane film. The assembly remained under vacuum for a further 30 minutes to cool the assembly to approximately 40° C. The vacuum was then removed from the assembly. Next, the vacuum bag was removed. The elastomeric ring around the heel area was then removed from the last. Finally, the completed 3-layer bootie was slowly and carefully removed from the foot last. To test for waterproofness, 400 cm$^3$ of water was poured inside the bootie and no evidence of leakage was noted after 30 minutes.

What is claimed is:

1. A method of forming a seamless bootie comprising:

applying a first adhesive on one of (1) a side of a first textile or (2) a side of a single sheet of extensible film having a minimum elongation at break value of 200% or more in at least one direction;

positioning said first textile on a last; and stretching said single sheet of extensible film over said first textile and said last, wherein the first adhesive is between the first textile and the extensible film, to form a first composite comprising said single sheet of extensible film, said first adhesive, and said first textile, wherein the extensible film is seamless.

2. The method of claim 1, wherein the last is a symmetrical last.

3. The method of claim 1, wherein the last is an asymmetrical last.

4. The method of claim 1, further comprising providing a second composite comprising a second adhesive and a second textile;

positioning said second adhesive of said second composite on the extensible film of said first seamless composite to form a seamless bootie; and heating said seamless bootie and said symmetrical last to a temperature from about 130 to about 150° C.

5. The method of claim 1, further comprising: applying pressure or vacuum to said bootie.

6. The method of claim 1, wherein said stretching step comprises:

positioning said extensible film over said last; and rotating said last to move through said extensible film to form said bootie.

7. The method of claim 1, further comprising positioning at least one polymeric overlay on said bootie.

8. The method of claim 1, wherein the extensible film is selected from the group consisting of polyurethane (PU), polyethylene (PE), polyester (PES), polypropylene (PP), polyether (PE), polyacrylonitrile (PAN), polystyrene, polyamide, polybenzimidazole (PBI), polycarbonate, polyethylene-co-vinyl acetate (PEVA), polyvinylchloride (PVC), cellulose acetate, polyimide, and block and random copolymers thereof.

9. The method of claim 1, wherein the extensible film is a porous extensible film and the porous extensible film is selected from the group consisting of polyurethane (PU), polyethylene (PE), polyester (PES), polypropylene (PP), polyether (PE), polyacrylonitrile (PAN), polystyrene, and copolymers thereof.

10. A method of forming a seamless bootie comprising:

applying a first adhesive on one of (1) a side of a first textile or (2) a side of a extensible film having a minimum elongation at break value of 200% or more in at least one direction;

positioning said first textile on a last; and stretching said extensible film over said first textile and said last, wherein the first adhesive is between the first textile and the extensible film, to form a first seamless composite comprising said extensible film, said first adhesive, and said first textile, wherein said stretching step comprises:

positioning said extensible film over said last; and rotating said last to move through said extensible film to form said bootie.

* * * * *